US006220776B1

(12) United States Patent
Reeves

(10) Patent No.: US 6,220,776 B1
(45) Date of Patent: Apr. 24, 2001

(54) JOINT FOR COLLAPSIBLE STRUCTURES

(76) Inventor: Francis J. Reeves, 357 Council Oak Dr., Severn, MD (US) 21144

( * ) Notice: Subject to any disclaimer, the term of this patent is extended or adjusted under 35 U.S.C. 154(b) by 0 days.

(21) Appl. No.: 09/179,403

(22) Filed: Oct. 27, 1998

Related U.S. Application Data

(63) Continuation-in-part of application No. 08/958,346, filed on Oct. 27, 1997, which is a continuation-in-part of application No. 08/288,309, filed on Aug. 10, 1994, now Pat. No. 5,681,231.

(51) Int. Cl.[7] ..... A63B 63/00

(52) U.S. Cl. ..... 403/102; 403/99; 473/421; 473/476

(58) Field of Search ..... 403/102, 101, 403/100, 99, 84, 113, 116, 117; 473/421, 476, 478

(56) References Cited

U.S. PATENT DOCUMENTS

| | | | | |
|---|---|---|---|---|
| 4,806,042 | * | 2/1989 | Swank et al. | 403/101 X |
| 5,178,583 | * | 1/1993 | Rankin | 403/100 X |
| 5,217,315 | * | 6/1993 | Rosane | 403/100 X |
| 5,333,434 | | 8/1994 | Oberman et al. | 52/645 |
| 5,348,414 | | 9/1994 | Dziuk et al. | 403/90 |
| 5,372,562 | | 12/1994 | Chang | 482/57 |
| 5,539,957 | * | 7/1996 | Schmidt | 403/102 X |
| 5,566,952 | | 10/1996 | Mullin et al. | 273/400 |
| 5,577,799 | * | 11/1996 | St. Germain | 403/102 X |
| 5,681,231 | | 10/1997 | Reeves | 473/471 |
| 5,681,238 | | 10/1997 | Minowa et al. | 477/102 |
| 5,746,533 | * | 5/1998 | Schmidt | 403/102 |

* cited by examiner

*Primary Examiner*—Lynne H. Browne
*Assistant Examiner*—John R. Cottingham
(74) *Attorney, Agent, or Firm*—Foley & Lardner

(57) ABSTRACT

A joint having a socket portion facilitates forming a collapsible structure. The joints can be formed as corner joints or straight joints and any number of members may be connected to the joints. The socket portion of the joint accommodates a movable member which has multiple degrees of motion. The movable member is connected with a threaded or otherwise twistable connection to the rod of a heim joint which rotates on a roll pin. The movable portion moves in and out of the socket portion to erect and collapse the structure. Frame members are attached to the fixed and movable portions of the joint. A cover plate on the joint assists in aligning the movable portion into the proper position so that the erect structure is stable.

22 Claims, 32 Drawing Sheets

JOINT FOR COLLAPSIBLE STRUCTURES

RELATED APPLICATIONS

This application is a Continuation-In-Part of application Ser. No. 08/958,346 by Francis J. Reeves entitled Joint For Facilitating Fabrication of Collapsible Assemblies, filed on Oct. 27, 1997, which is a Continuation-In-Part of Ser. No. 08/288,309 filed Aug. 10, 1994 by Francis J. Reeves for a Collapsible Game Goals which is now U.S. Pat. No. 5,681,231 issued on Oct. 28, 1997. Both of these applications are incorporated herein by reference.

BACKGROUND OF THE INVENTION

The invention relates to joints for use with collapsible structures. The invention has particular application to collapsible game goals. Games such as soccer, hockey and lacrosse require a goal incorporating a net. These goals are often large and not easily transportable. It is therefore inconvenient to use the same game goal to support games occurring at different times and at different locations.

The lack of mobility of the goals is a function of their size and the fact that they cannot be collapsed, folded or disassembled. Similar difficulties occur with other devices and assemblies where transportability is desirable, but the requirements of physical size and strength prevent such assemblies from being collapsed.

SUMMARY OF THE INVENTION

It is therefore an object of the invention to provide a assembly, such as a game goal, which is easily collapsible.

It is another object of the invention to provide a link for joining members of such a assembly.

These and other objects of the invention are accomplished by a joint according to the invention which facilitates collapsible structures.

BRIEF DESCRIPTION OF THE DRAWINGS

The invention is described with particularity with reference to the figures in which:

FIG. 26*a* illustrates a cross section of the flat fixed member shown in FIG. 26;

DETAILED DESCRIPTION OF THE EMBODIMENTS

Figure 1:
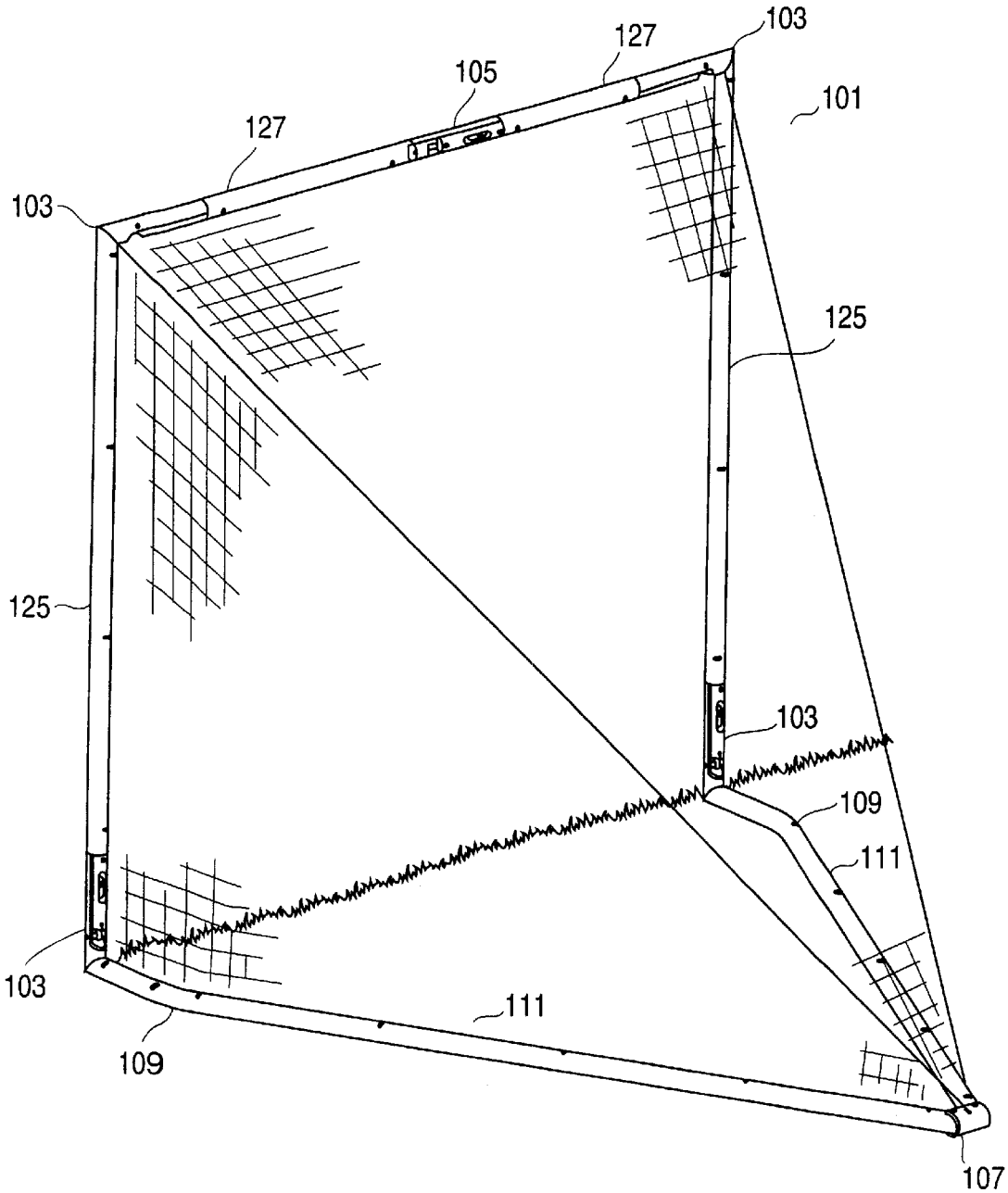
FIG. 1 illustrates a game goal incorporating joints and links according to the invention in the erect position ready for use.

FIG. 1 illustrates a structure, such as a game goal 101 which incorporates joints and links according to the invention. FIG. 1 is shown with game goal 101 in an erect position. The goal 101 in FIG. 1 has corner joint 103, straight joint 105 and point joint 107, each of which facilitates collapsing of the structure. As discussed further herein, corner joints 103 can be formed, for example, by welding two straight parts together. Also shown in FIG. 101 are dog legs 109 in the portions of the structure which contact the ground. Dog legs 109 are used, for example, in a lacrosse goal, when the base or ground frame members 111 comprise ground pipes. As used herein the term "dog leg" is any pipe with a bend. The dog leg is useful for preventing a ball from deflecting off the round pipe back into the playing field, making it difficult to determine whether a goal was actually scored. As discussed further herein, where the base or ground frame members 111 are flat bars, as permitted under the rules of National College Athletic Association (NCAA), dog legs 109 are not necessary because balls are much less likely to deflect off a flat bar protruding only a short distance, e.g., one half inch, above the ground. The dog leg ground members as shown in FIG. 1 also meet NCAA specifications.

As previously noted, FIG. 1 shows a goal 101 with the net attached in the fully erect position. Joints 103, 105 and 107 are also shown in the preferable orientation of their sockets. As further discussed herein, however, it will be know to those of ordinary skill that other orientations could be employed. Thus, the invention is not limited to the particular configuration or orientation of joints shown in FIG. 1, but may included other configurations and orientations as well.

Figure 2:
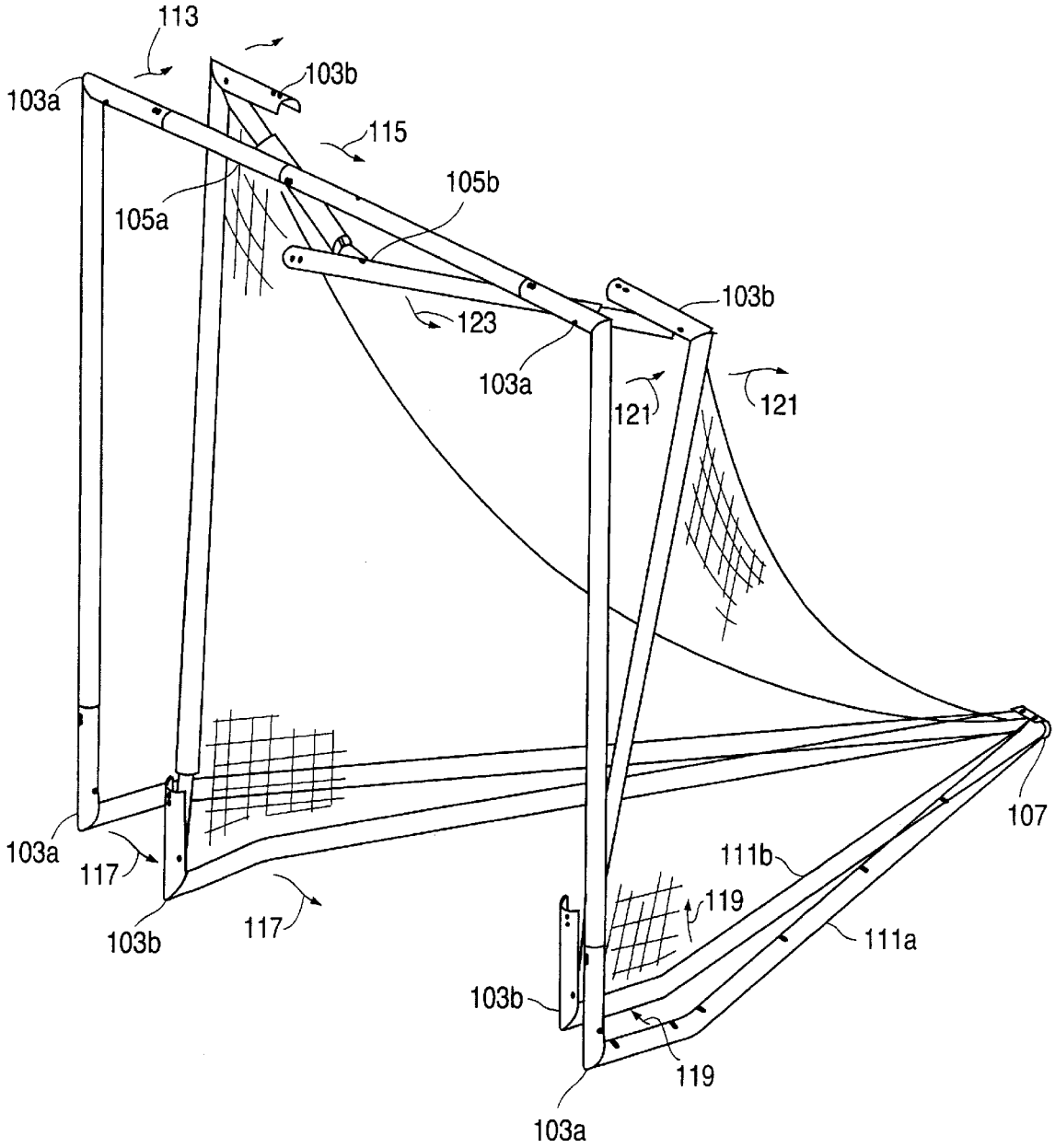
FIG. 2 is a perspective view of the goal shown in FIG. 1 in an intermediate position transitioning from the erect position to the collapsed position.

FIG. 2 is a perspective view of the goal shown in FIG. 1 in an intermediate position transitioning from the erect position, shown with the designations "a" for the members and joints, to the collapsed position, with the intermediate positions of the joints and members shown as "b." Arrows 113, 115, 117, 119, 121 and 123 indicate the direction of motion of the members as this particular structure transitions from the erect position to the collapsed position. Those of ordinary skill will recognize that other structures may use the joints according to the invention to form collapsing structures other than that shown herein. However, the collapsing structure in FIG. 2 is believed to be an optimum collapsing structure for a lacrosse goal.

Figure 3:
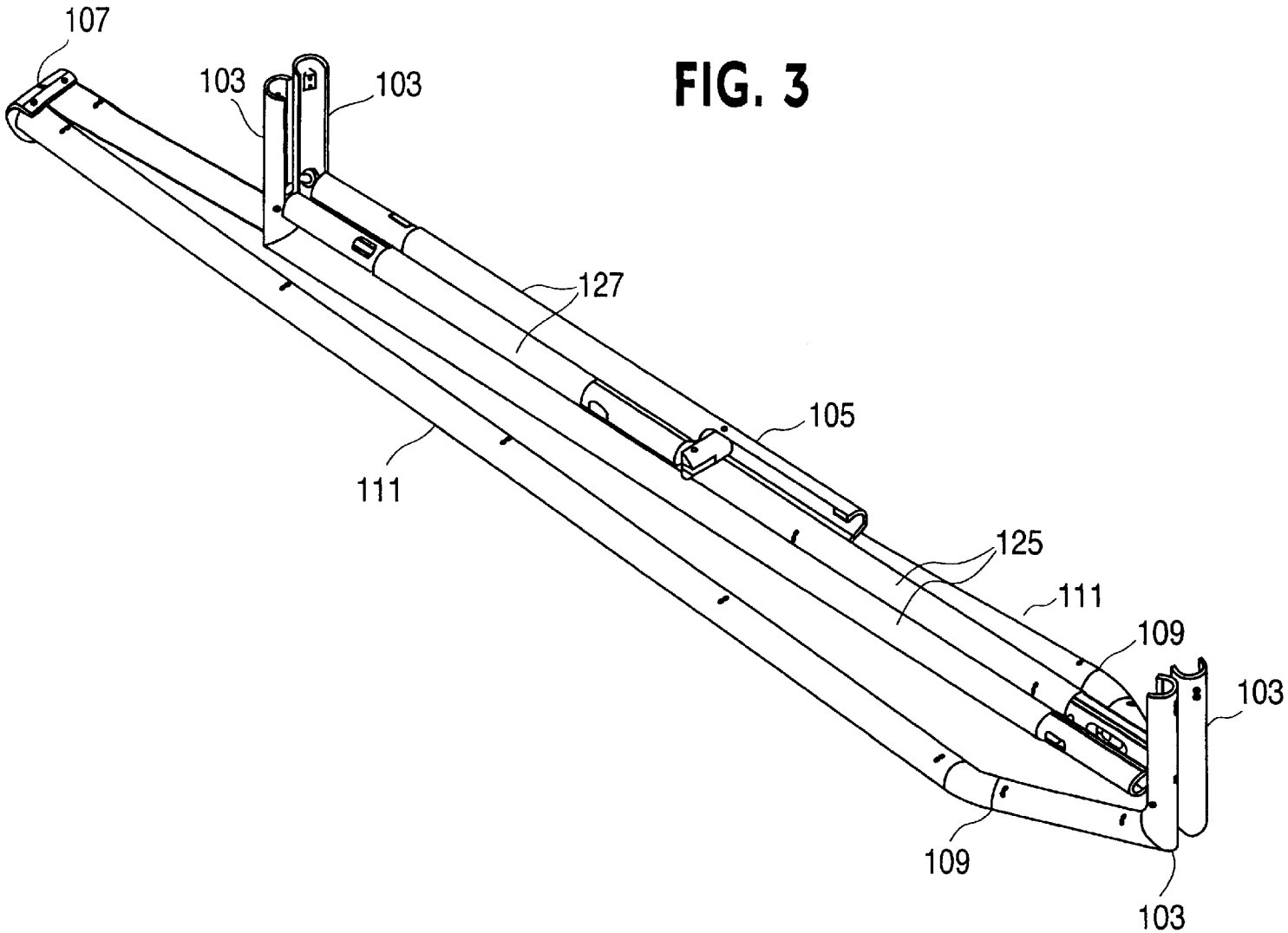
FIG. 3 is a perspective view of the goal shown in FIGS. 1 and 2 in the fully collapsed position.

FIG. 3 illustrates the lacrosse goal shown in FIGS. 1 and 2 in the fully collapsed position. FIG. 3 illustrates the position of ground frame members 111, cross bar members 127 and uprights 125 along with the individual joints 103, 105 and 107 when the game goal is collapsed. An important feature of the invention illustrated in FIG. 3 with respect to a collapsible structure is that the invention provides a coordinated twisting of members so that all joints can be twisted to work together without binding, as discussed further herein.

Figure 4:
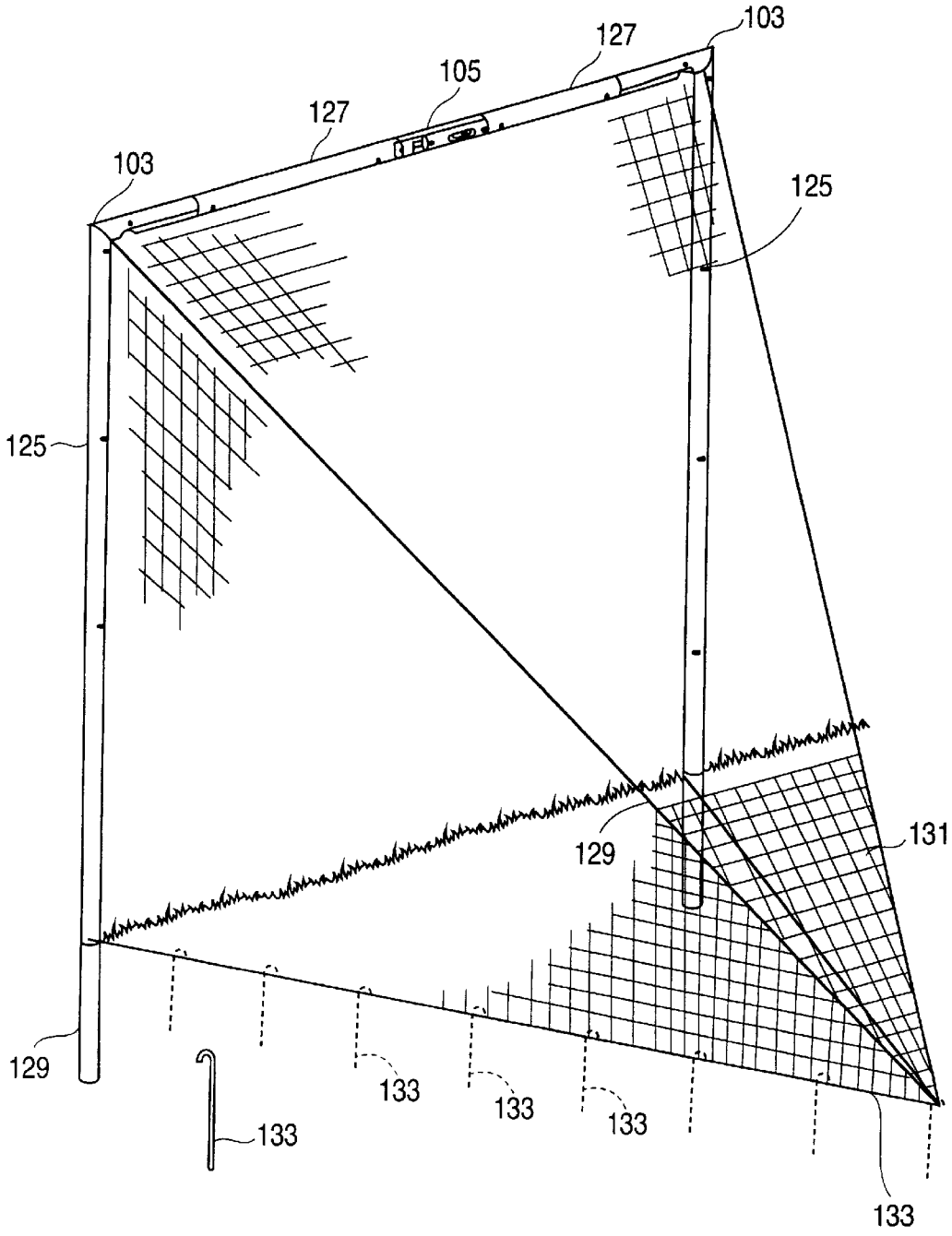
FIG. 4 illustrates a collapsible game goal with base members that can be inserted to the ground.

FIG. 4 illustrates a collapsible game goal in accordance with the invention wherein the base portion of the goal can be inserted into the ground. In FIG. 4, vertical frame members 125 have an extension 129 which can be inserted into the ground and extends below the ground level. Net 131, which is fastened to the vertical frame members 125 and the cross bars frame members 127, as well as corner joints 103, is fastened to the ground using one or more members 133, as shown in FIG. 4. Net securing members 133 are shown shaped as an inverted letter "J", but could have any convenient shape which allows insertion of the member into the ground such that it encloses the edge 135 of the net 131 where it intersects the ground. Thus, an inverted "V" or an inverted "U" or other similar shape could be used for member 133. The configuration shown in FIG. 4 is advantageous in that it requires fewer corner joints 103, avoids the need for point joint 107 and eliminates the need for base members 111. As a result, the configuration in FIG. 4 is lighter and even more portable and meets NCAA specifications.

Figure 5:
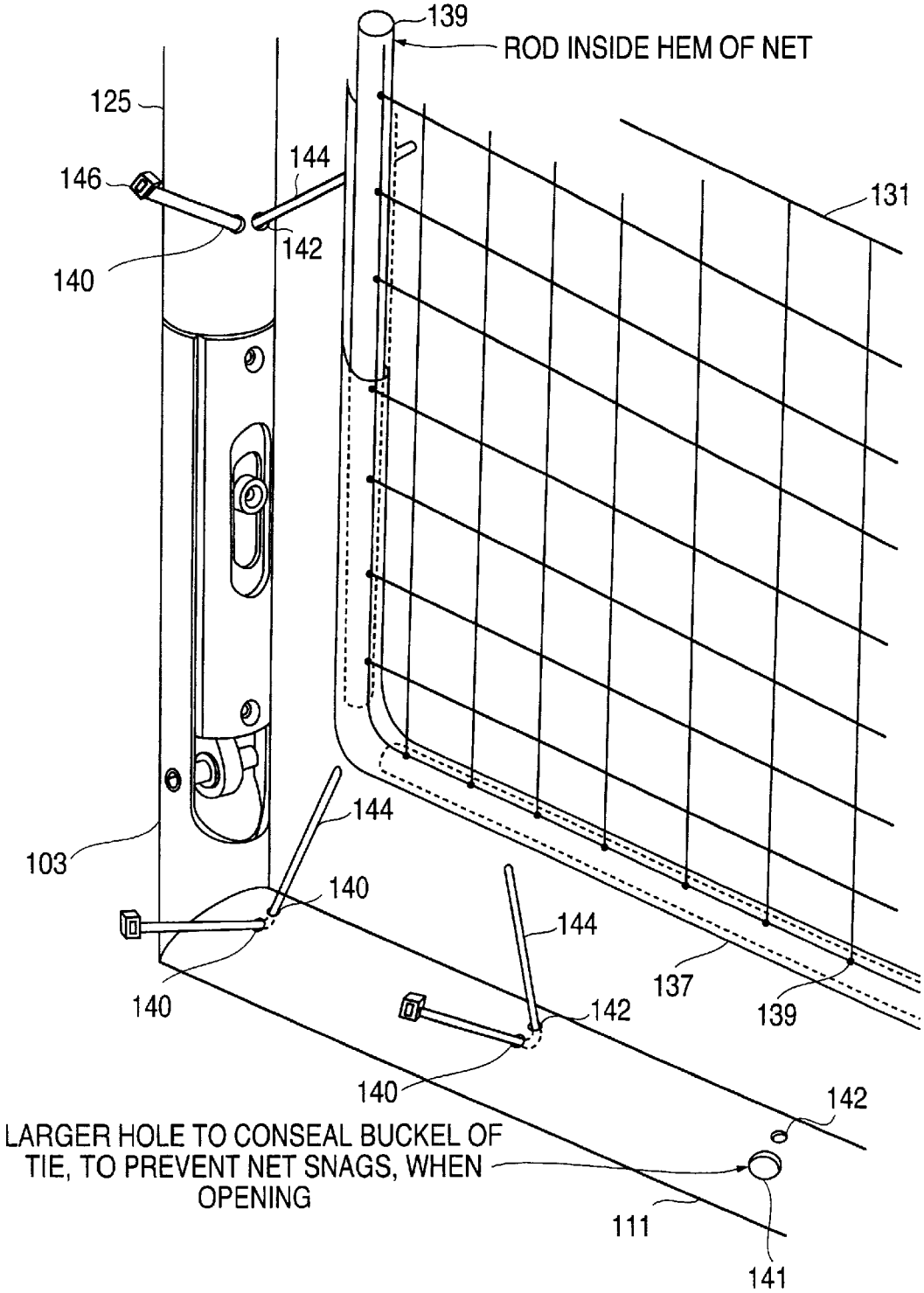
FIG. 5 illustrates an attachment between a net and the frame of a game goal according to the invention.

FIG. 5 illustrates an improved attachment between the net 131 and the frame of a game goal. The attachment shown in FIG. 5 can be used whether the game goal is of the collapsible and portable configuration or is of the fixed type. According to the invention, net 131 has a hem 137 with a rod 139 inserted therein. Conventional goals do not have the rod in the hem. The rod can be of any suitable ridged or semi-ridged materials such as metal, fiberglass or plastic and may be hollow or solid. FIG. 5 shows the intersection of the net with a vertical frame member 125 and a base frame member 111 at corner joint 103. However, those of ordinary skill will recognize that the same principles apply around the entire structure. As shown in FIG. 5, the members, such as vertical frame members 125, base frame member 111 and corner joint 103 has holes 140 and 142 drilled therein. A zip tie, such as that used to bundle electrical wires together, or other fastener 144 is passed through holes 140 and 142, around hem 137 with rod 139 therein. This holds the net 131 close to the frame wherever the rod is inserted in the hem of the net. In order to prevent snagging of the net when the goal is being changed from a collapsed to an erect position, or at various other times, one of the holes e.g. 141, can be made slightly larger than hole 142, as shown in FIG. 5. This allows insertion of the buckle 146 of zip tie 144 into hole 141 so that a portion of the zip tie buckle is concealed below the outer diameter. This could also be accomplished by countersinking the hole or holes for the fasteners of the frame member. As a result, the net cannot snag on the net fastener. By using the rigid member 139 in the hem 137, it is not necessary to use a large number of zip tie connections to the frame members. Although the frames can be manufactured with any number of holes to accommodate net fasteners, it will not be necessary to use a net fastener in each and every hole along the perimeter of the net, as is done in conventional goals. One need only attach the net 131 to the frame members with as many net fasteners as is necessary to maintain the net in good connection with the frame structure.

One need only use a sufficient number of net fasteners to fasten the rod in the hem of the net to the frame such that a ball, puck or other object used in a game cannot pass between the hem of the net and the frame member.

For the left upright 125 of the goal in FIG. 1, fastening the rod 139 in the hem 137 of net 131 with four net fasteners makes it impossible for a ball to pass between the net and frame member 125. Other goals of other configurations may require fewer or greater number of fasteners to prevent a ball from passing between a net and the frame member.

The net attachment according to the invention herein can reduce the time required for net replacement and reduce manufacturing and assembly costs, because fewer fasteners are needed then in conventional goals. Positioning the net fastener holes away from the opening in the front of the goal allows an aesthetically pleasing attachment of the frame to the net and leaves the opening of the goal free of net fasteners.

An alternative to the net fasteners shown in FIG. 5 is to use a single hole with a generally u-shaped net fastener as disclosed in application Ser. No. 08/288,309 previously incorporated herein by reference. The net remains attached at all times to the frame whether in the erect or collapsed position.

Figure 6:
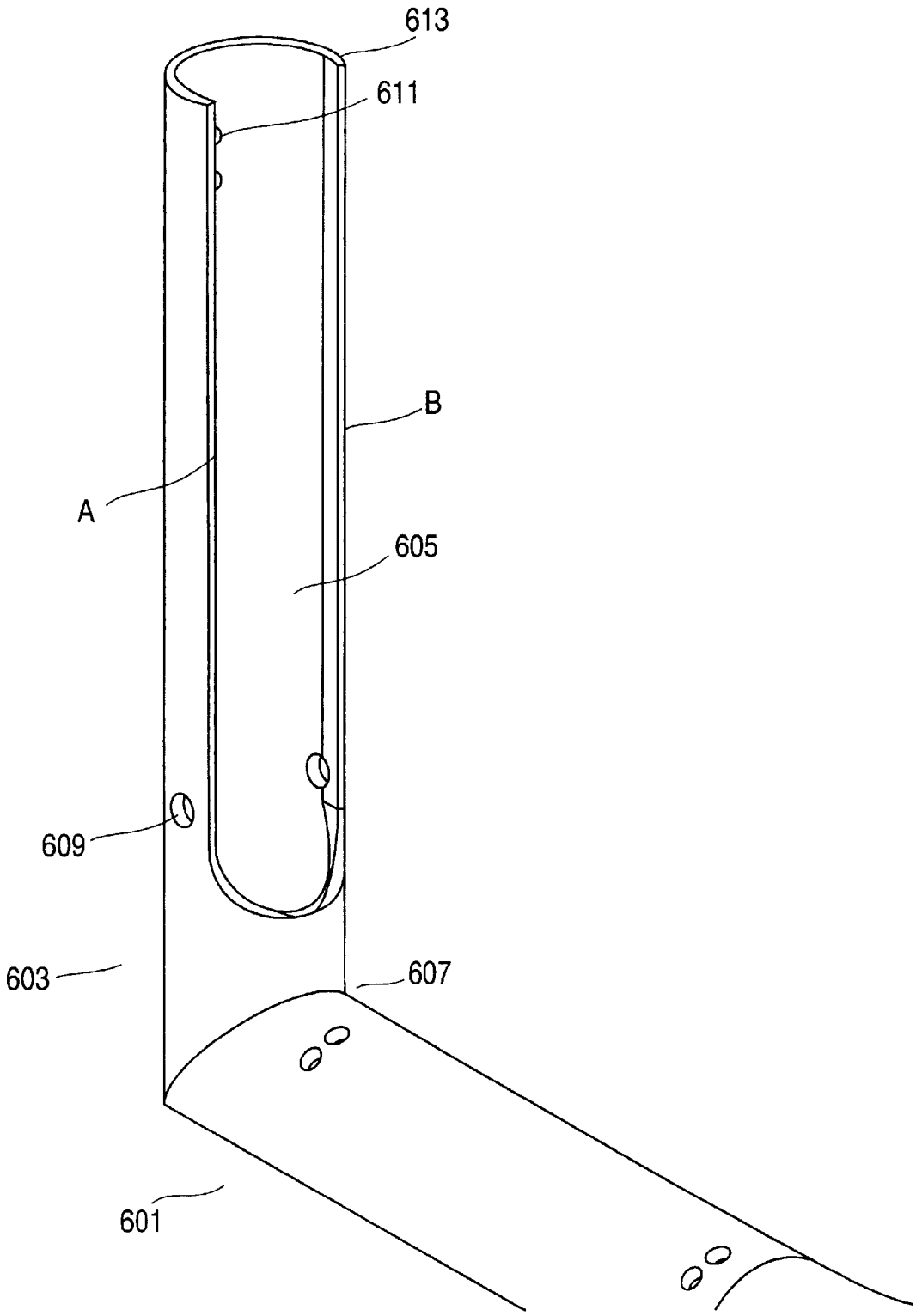
FIG. 6 illustrates structural members used in forming a joint according to the invention.

FIG. 6 illustrates some of the structural members used in forming a corner joint 103. In FIG. 6 straight members 601 is connected to hollow pipe member 603 having a socket portion 605 therein. Member 601 is connected to portion 603 at joint 607 using a suitable connection technique. Preferably, if the member 601 and member 603 are metal, they are connected by welding at joints 607. To achieve a 90 degree elbow shape, the connection is preferably made with a 45° mitre on the ends of members 601 and 603. However, it will be known that other shapes and other angles can be used to achieve different angular relationships between members 601 and 603. As shown in FIG. 6, member 603 having socket 605 therein preferably has holes 609 and holes 611, which are discussed further herein. As shown at 613 in FIG. 6, socket portion 605 preferably has a mouth portion which is an opening for example between points A and B which is smaller than the inner diameter of the pipe 603 in which the socket portion is formed. For example, the mouth of the socket portion could measure 1.600 inches between points A and B, while the inside diameter of the pipe is 1.615 inches. The purpose of this difference in dimension is to allow the socket portion to provide a snap fit to a member which is eventually pressed through the socket mouth. The snap fit is accomplished as a result of flexing in the material the socket is made of.

Figure 7:
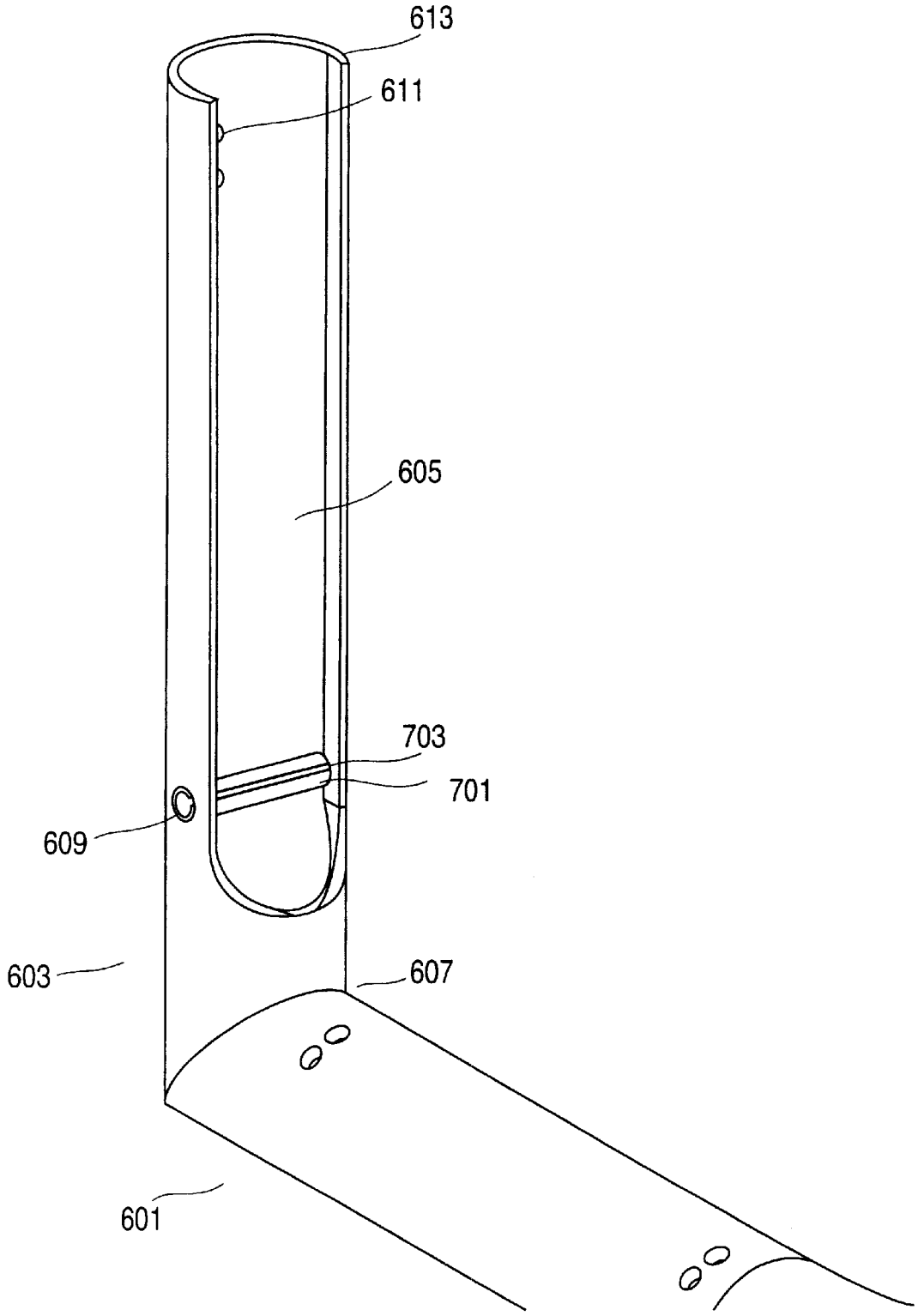
FIG. 7 illustrates a joint with a roll pin inserted therein.

FIG. 7 illustrates that the socket portion 605 with a roll pin 701 inserted into the holes 609. The roll pin 701 has a gap 703 along the length of the pin so that the roll pin can be pressed in and inserted into the holes 609. The spring effect of releasing the compression of the roll pin after insertion into holes 609 maintains the roll pin 701 in the holes 609, thereby keeping the roll pin in the socket portion 605.

Figure 8:
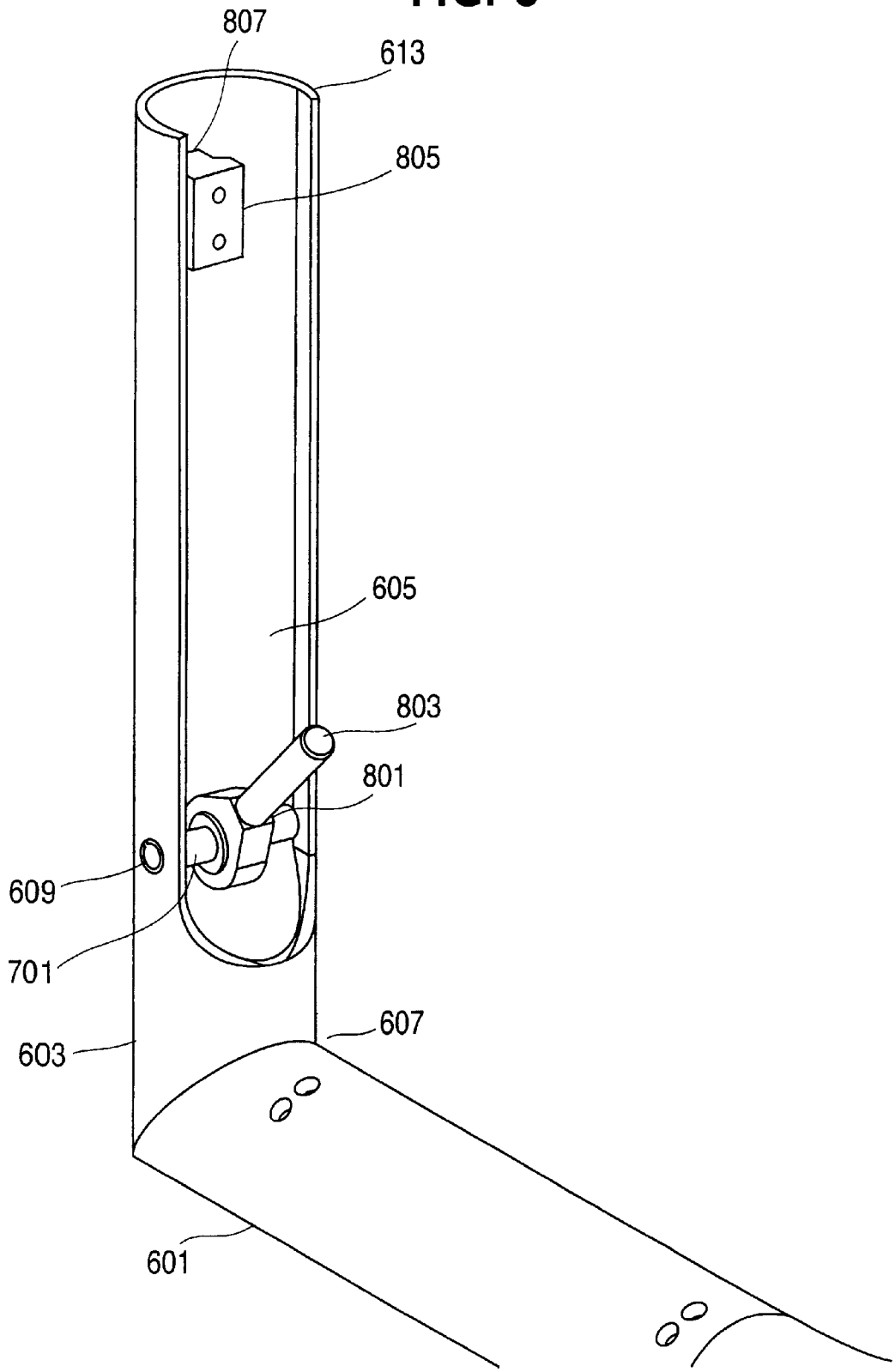
FIG. 8 illustrates a joint with a lock wedge and heim joint inserted therein.

FIG. 8 illustrates roll pin 701 with a rod end ball joint 801, known as a heim joint thereon. Those of ordinary skill will recognize that a member attached to a rod end ball joint or heim joint will experience multiple degrees of freedom of motion, which are allowed by a heim joint. The function of the heim joint is discussed in more detail herein. During the assembly process, the heim joint is positioned on roll pin 701 at a position on the roll pin where the rotation of the heim joint is to occur. The position can be set for example using spacers which are removed after the heim joint and roll pin are positioned into the socket 605. After the heim joint is positioned in the desired location within socket 605, the roll pin 701 is pressed into the holes 609 and simultaneously in the hole in the heim joint. As previously noted, roll pin 701 has gap 703 along its length, which expands to hold the roll pin in the holes 609 of socket portion 605. The expansion of the roll pin by its spring force also serves to maintain the heim joint 801 in its desired position. At that time, if spacers have been used to position the heim joint on the roll pin, the spacers can be removed, since the position of the heim joint is now fixed. The heim joint has rod 803, which can be threaded into a plug which holds the heim joint into a movable member (not shown in FIG. 8), as discussed further herein.

FIG. 8 also illustrates lock wedge 805 attached in holes 611 in socket portion 605. As discussed further herein lock wedge 805 engages a lock slider thereby further assuring the movable member remains in place when the frame is in the erect position. Surface 807 which contacts socket portion 603 has a slant or taper, e.g., 1.50, along its length thereby forming a wedge.

Figure 9:
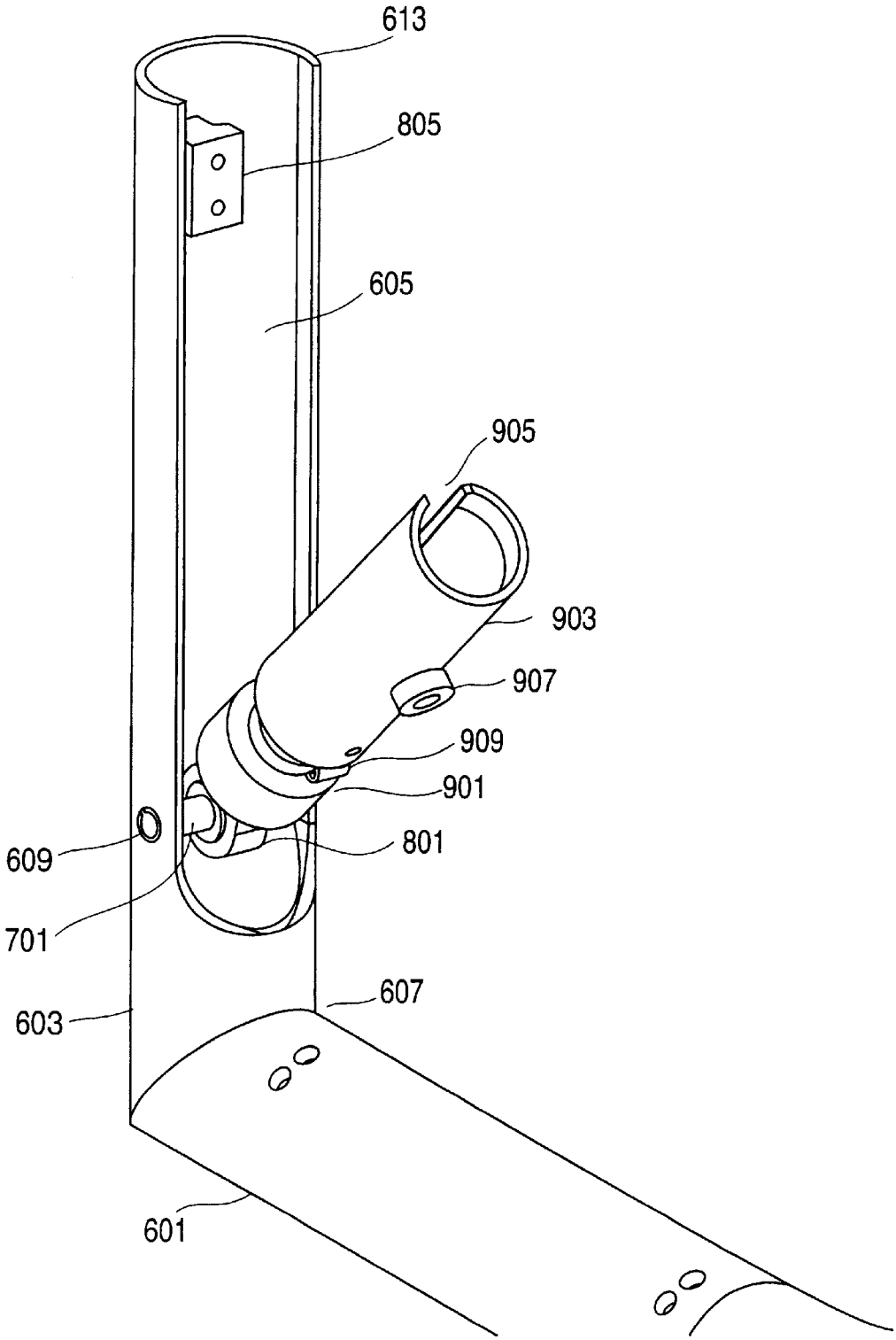
FIG. 9 illustrate the joint of FIG. 7 with a plug, lock slider and handle thereon.

FIG. 9 illustrates rod 803 of heim joint 801 inserted into plug 901. As discussed further herein and shown in FIG. 10, plug 901 will allow a movable member **125*a* to be connected to the heim joint. FIG. 9 also shows a lock slider 903. Lock slider 903 has a gap 903 therein, as shown. As further discussed herein, lock slider 905 can be positioned slidably to intersect lock wedge 805 in order to lock the movable member into the socket portion 605. As previously noted, socket portion 605 is preferably formed such that the movable member has a snap fit with the socket portion 605. Lock wedge 805 assures that the movable member remains in the socket portion in the erect position. Manipulation of lock slider 903 is facilitated through handle 907**.

FIG. 9 also shows a P-clip 909. The P-clip includes a protrusion, as shown at 909, which creates drag between the lock slider and a pipe forming the movable member as the P-clip slides therein.

The P-clip is mounted on the inside of the lock slider 909 as to partially protrude past the outside diameter of the lock slider. When the lock slider is inserted into a movable member this protrusion creates a spring like resistance which crates drag in the lock slider. This drag helps to prevent unlocking of the joint during normal use.

Figure 10:
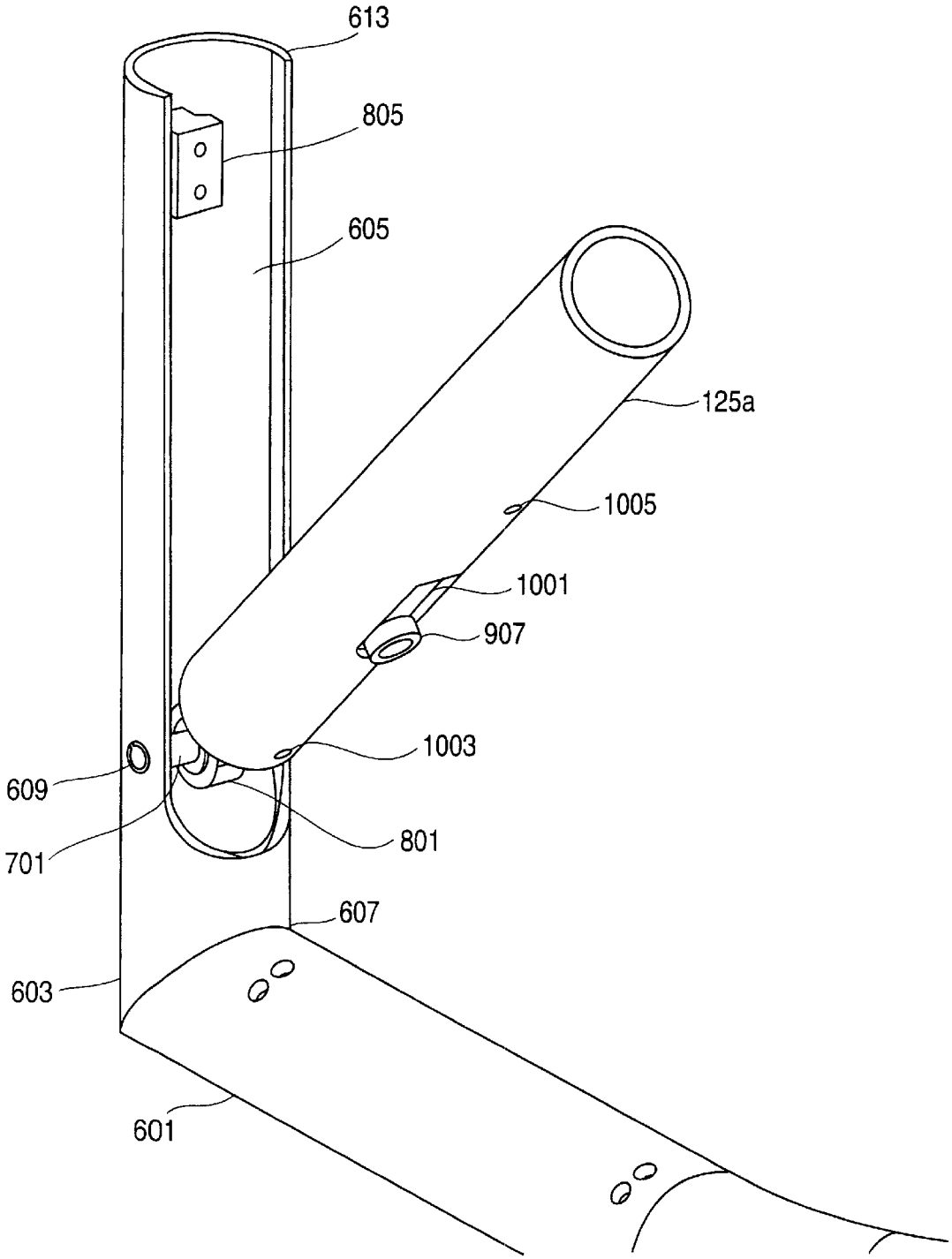
FIG. 10 illustrate the joint of FIG. 9 with a movable member inserted thereon.

FIG. 10 shows the P-clip 909, lock slider 903 and plug 901 all inserted into a pipe forming movable member **125*a*. FIG. 10 is a front view and illustrates that the movable member 125*a* has screw holes 1005 and 1003 therein which are used for fastening a cover to the movable member. As further discussed herein, hole 1003 has a screw inserted therein which threads into plug 901, thereby securing the movable member 125*a* to the plug which has threads and holds the heim joint 801. Screw hole 1005 accommodates a screw which keeps the cover in place and does not protrude into the inner diameter of the movable member. It should be noted that handle 907 is inserted into the lock slider 903 after the lock slider, plug 901 and P-clip 909 are inserted into the movable member. In this way, handle 907, which can only move in the space provided by window 1001, controls the position of lock slider 905 inside movable member 125*a***.

Figure 11:
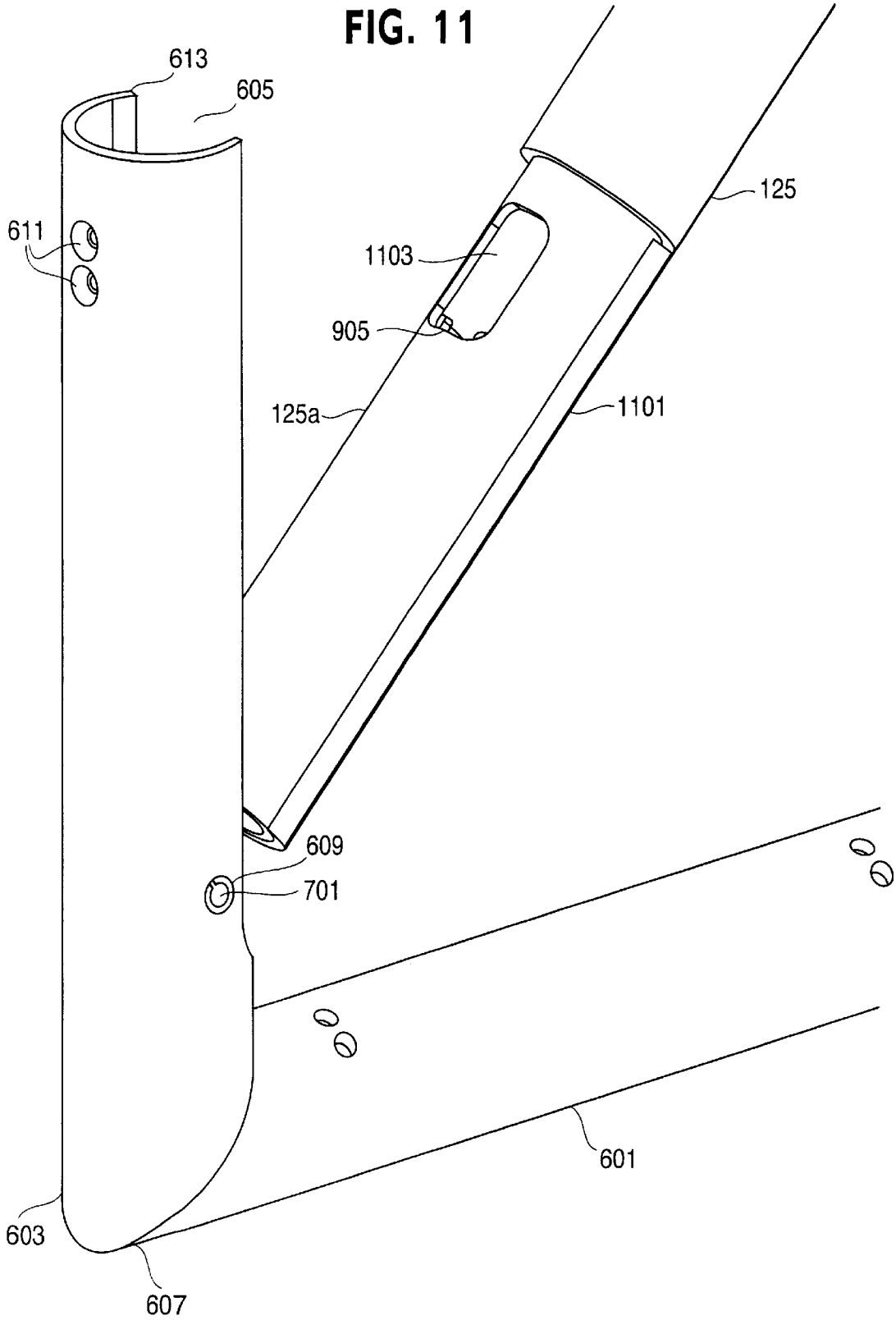
FIG. 11 gives a rear view of the joint shown in FIG. 10 with cover and upright attached.

FIG. 11 illustrates a rear view of the connection between the movable member **125*a* and the socket portion 605 of the joint according to the invention. Screw holes 611 illustrate where lock wedge 805 is fastened to the inside portion of socket portion 605. Cover 1101 on the movable member has several purposes. The first purpose is to provide a uniform outer diameter for the movable member 125***a* when the movable member is inserted into the socket portion 605 and frame member 125 is attached thereon. The cover portion 1101 also serves to align the pipe forming movable member 125*a* into the engaged position in the socket member 605. Thus the cover portion helps prevent the movable member from becoming misaligned and forces the movable member into a smooth engagement with the socket portion 605. FIG. 11 also illustrates a window 1103 through which lock wedge 805 protrudes into the inner diameter of the movable member in the engaged position. When the movable member is placed completely into the socket portion, the user simply slides lock slider 903 over lock wedge 805 by moving lock handle 907 within the range permitted by window 1001. This wedging effectively locks the movable member to the socket using internal mechanisms.

Figure 12:
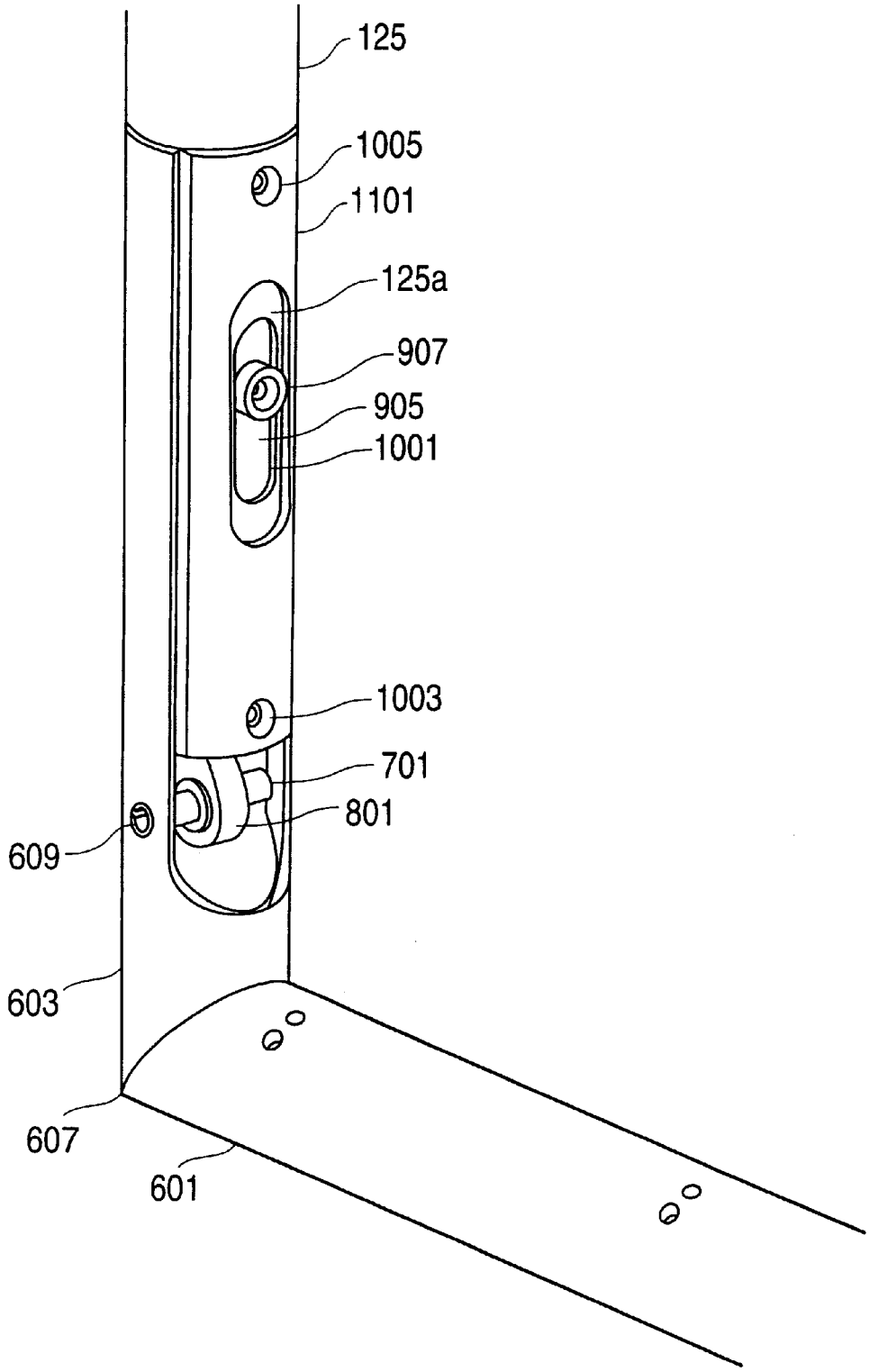
FIG. 12 shows the joints of FIG. 10 in the fully engaged position.

FIG. 12 shows the joint assembled with the movable member 125 in the fully erect position. As previously noted, bottom screw 1003 and top screw 1005 serve to attach the cover plate 1101. In addition, bottom screw 1003 protrudes into the plug 901 of the heim joint 801 thus affixing the movable member to the plug. Screws 1003 and 1005 are countersunk so as not to protrude beyond the outer diameter of the frame member. In addition, a screw 10005 that is placed is of a length such that it does not protrude into the inner diameter of the movable member 125*a* so that there is complete clearance for movement of lock slider 903 in the inner diameter of the movable member. Frame member 125 fits over movable 125*a,* so that frame member 125 moves with movable member 125*a*. Frame member 125 and movable member 125*a* may according to the invention be integrated into one piece.

Figure 13:
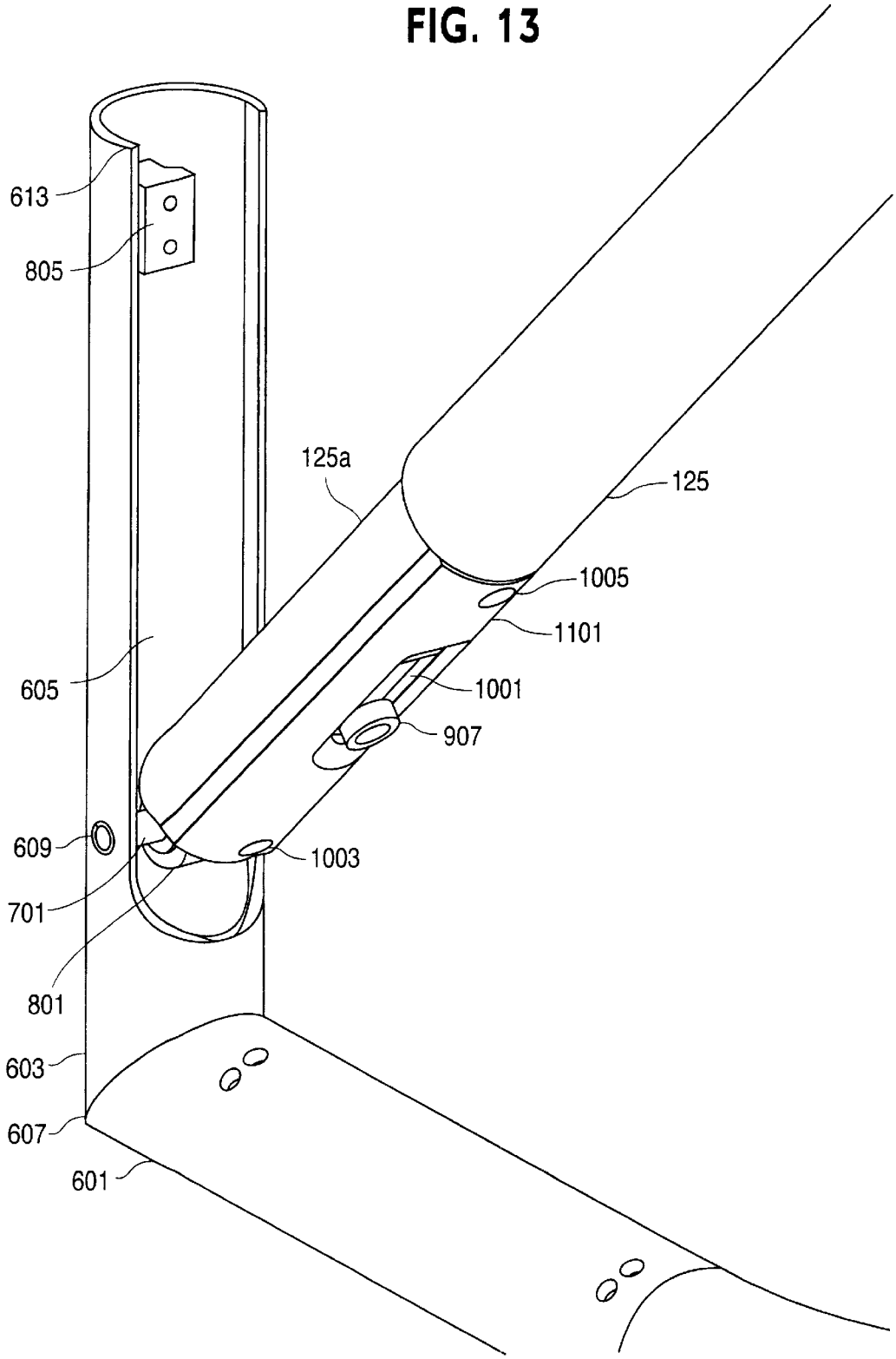
FIG. 13 shows the corner joint the movable member in a disengaged position.

FIG. 13 shows the movable member 125*a* in a disengaged position, which would be used for collapsing the assembly. As previously noted herein, in order to efficiently collapsed such an assembly it is important to provide some twisting of the movable member. According to the present invention, the movable member can twist as a result of the movable member's connection to the plug 901 and the heim joint 801. Plug 901 is rotatably attached via a screw thread to rod 803 of the heim joint 801. Thus, as the movable member is disengaged and collapsed, it is free to rotate because it is fixedly attached to the plug which is free to turn on the threaded attachment of the plug 901 to the rod 803 of the heim joint 801. This arrangement provides an added degree of motion, allowing the apparatus to be collapsed in the most efficient manner. On the other hand, when the apparatus is assembled into the erect position, the fit between the cover 1101 and the member 603 with slot 605 therein causes the movable member to rotate in the same manner into a proper position to fit into the slot portion 605. As a result, the assembly according to the invention provides an efficient way to erect and collapse a structure using a gapped or slotted member 603 and an ungapped member.

Figure 14:
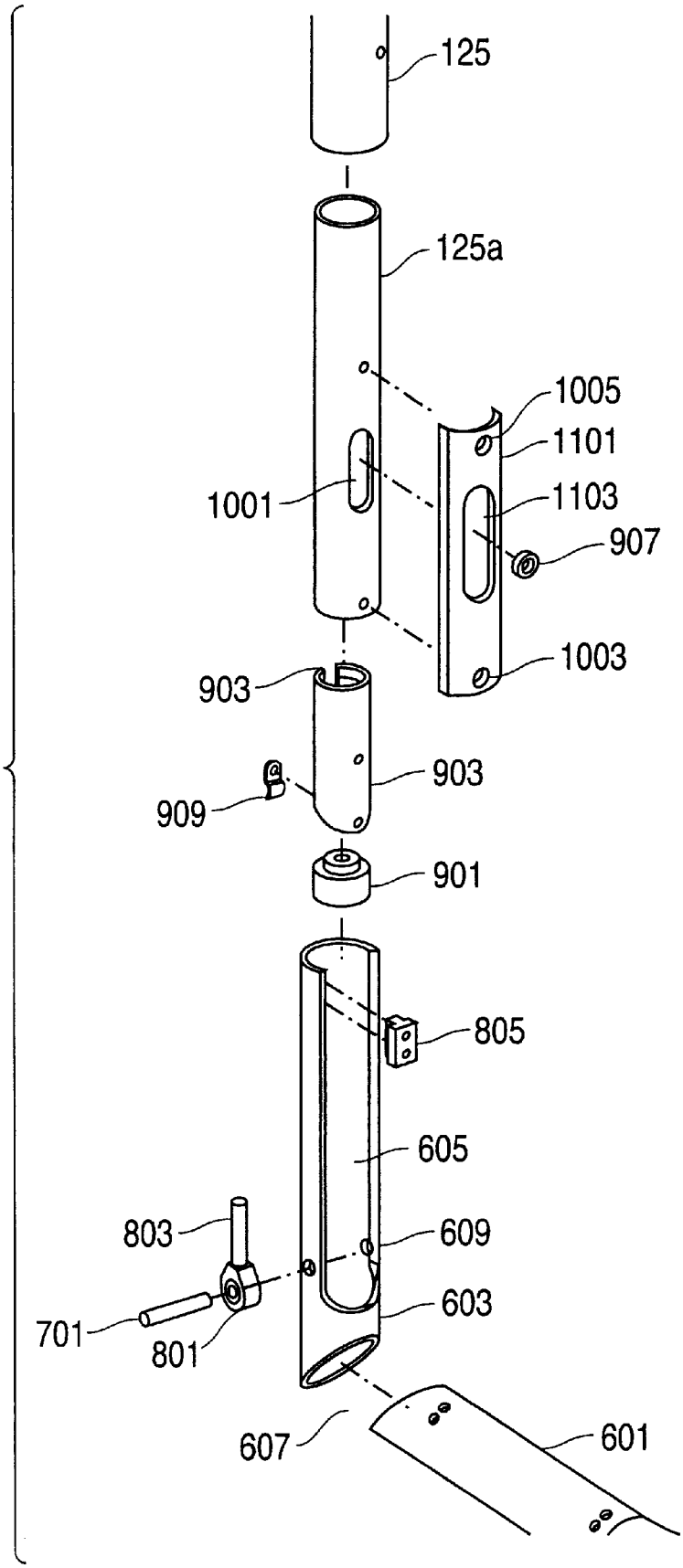
FIG. 14 is an exploded view of the assembly of the corner joint according to the invention.

FIG. 14 is an exploded view of the assembly according to the invention as just described. As clarified in FIG. 14, frame member 125 attaches over pipe 125*a* which moves in and out of the socket portion 605. Thus movable member 125*a* has an outer diameter which permits frame member 125 to slide over the movable member.

Figure 15:
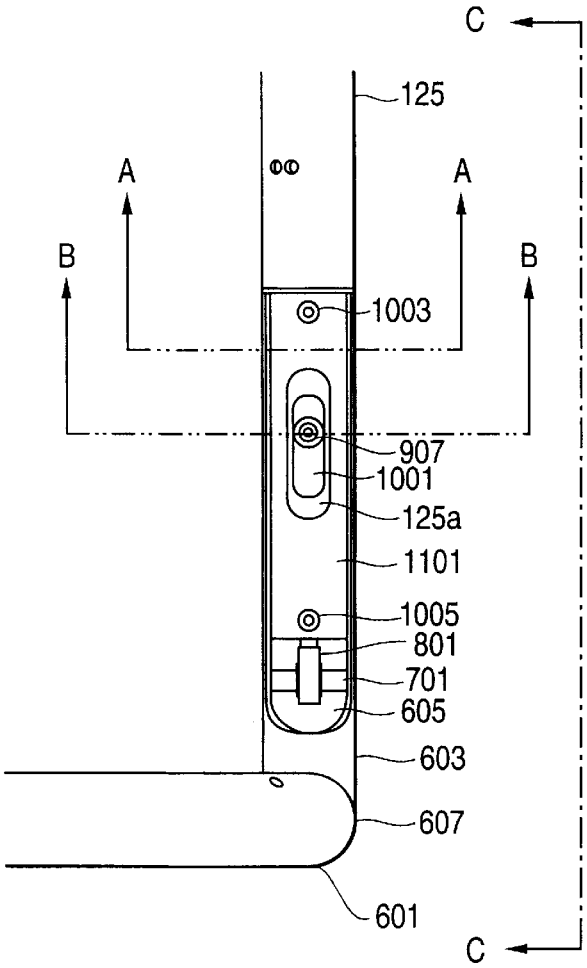
FIG. 15 is another view of the corner view according to the invention.
Figure 15A:
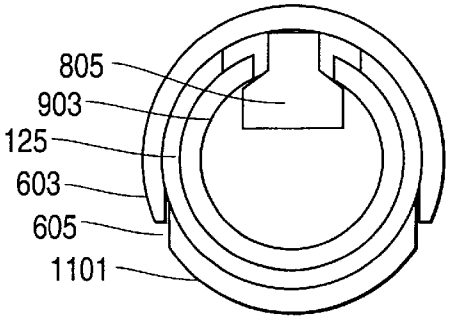
FIG. 15*a* is a cross section of the joint shown in FIG. 15 taken through the lock wedge.
Figure 15B:
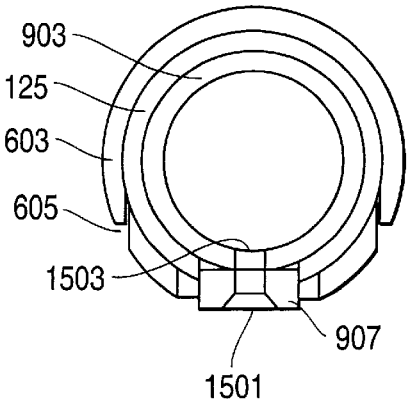
FIG. 15*b* is a cross section of the joint shown in FIG. 15 taken through the handle.

FIG. 15 is another view according to the invention of a corner joint. FIG. 15*a* is a cross section taken through lock wedge 805. FIG. 15*b* is a cross section seen through handle 907. As illustrated in FIG. 15*b,* handle 907 is fastened to lock slide 903 using screw 1501 which engages hole 1503 and lock slider 903. These cross sections illustrate that a plurality of structural members (in this case, three structural members) are configured such that cover portion 1101 and socket portion 603 form a smooth outer diameter. Other details of the construction consistent with the previous figures are shown in FIGS. 15, 15*a* and 15*b*.

Figure 16:
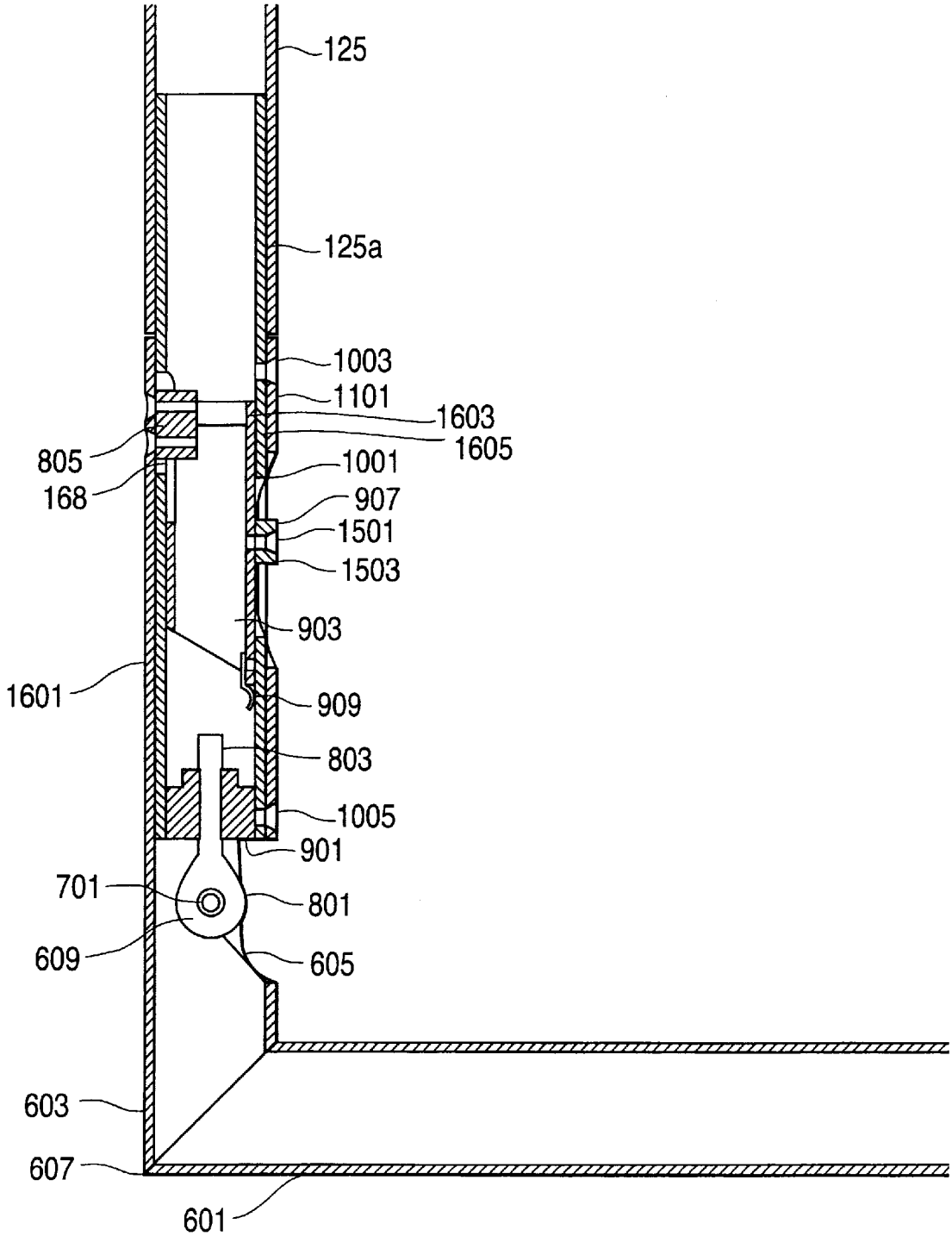
FIG. 16 is a cross section along line 6—6 in FIG. 15 showing a corner joint according to the invention assembled in the engaged position.

FIG. 16 is a cross section showing a corner joint assembled in the engaged position. In particular, FIG. 16 is an interior view of the corner joint in the assembled and engaged position. FIG. 16 illustrates how P-clip 909 slides along the interior of pipe 125*a* that forms the movable member of the joint. P-clip 909 thus creates drag which affects the motion of lock slider 903, FIG. 16. It also illustrates the connection between rod 803 of heim joint 801 and plug 901. As previously discussed, screw 1005 extends through cover 1101 and pipe 125*a* into plug 901, while screw 1003 extends through cover 1101 into pipe 125*a,* but does not extend beyond the inner diameter of pipe 125*a*. This allows free range of motion of the lock slider 903 using handle 907. FIG. 16 also shows that lock slider 903 has an angle cut 1601 on its backside to allow screwdriver clearance when installing a bolt (not shown) to fasten P-clip 909. Lock slider 903 also has a beveled edge 1603 on its forward end which facilitates its engagement and motion into the lock wedge 805. Only edge 1603 is beveled. The remaining portion 1605 of lock slider 903 intersecting lock wedge 805 has no such bevel.

Figure 17:
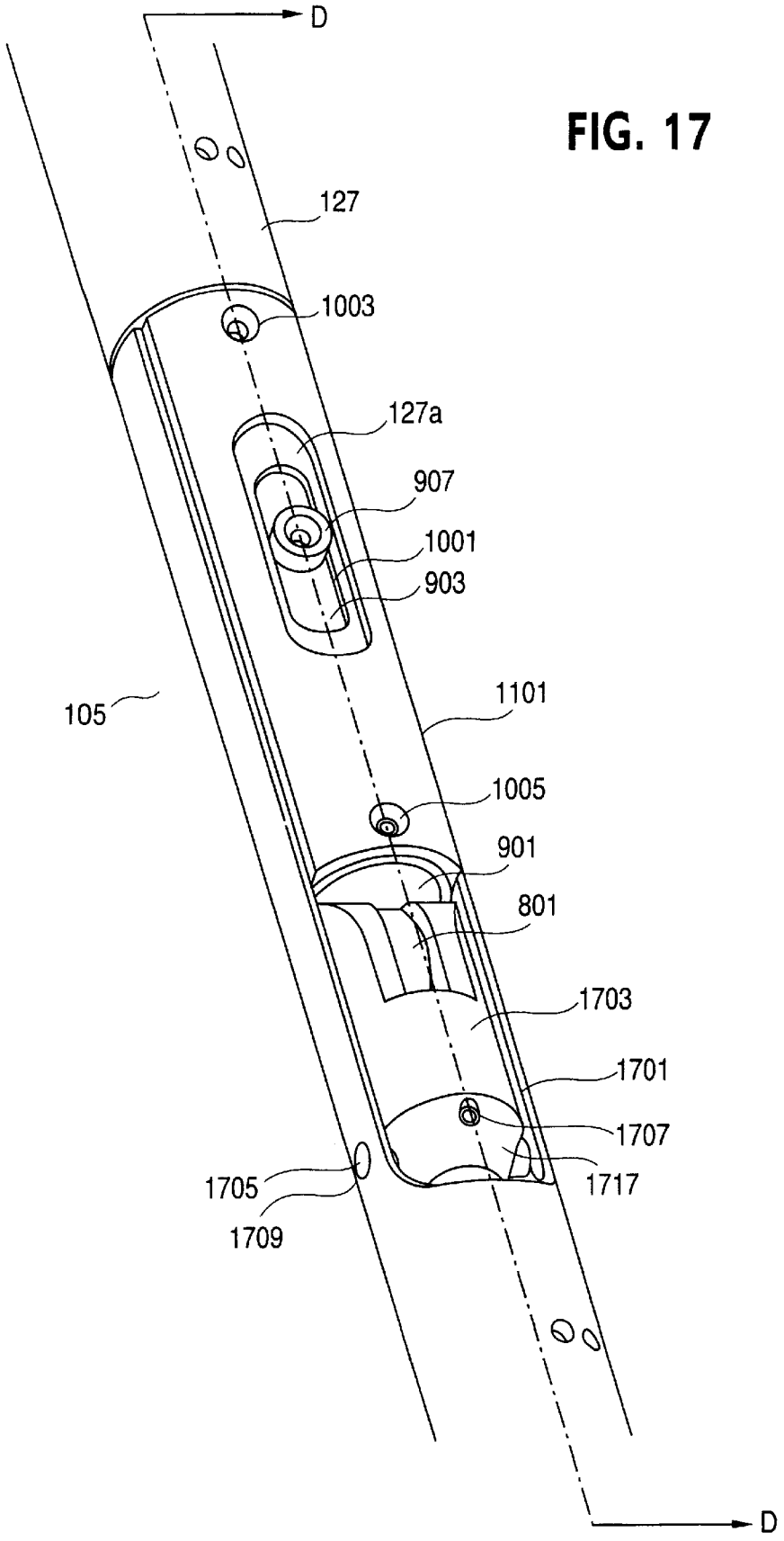
FIG. 17 illustrates a straight joint with a kick out member according to the invention in the engaged position.

FIG. 17 illustrates a straight joint according to the invention, for example, as would be used as a joint 105 to collapse frame members 127 of the cross bar shown in FIG. 1. On one end the straight joint connects to frame member 127 through a movable member formed by pipe 127*a*. FIG. 1 shows the joint in the assembled and engaged position. Straight joint 105 has substantially the same structure as the corner joint 103 discussed previously herein. Straight joint 105 has a heim joint 801 with a rod 803 engaging plug 901. The remaining portion of the structure of the joint is the same as that for the corner joint except for incorporation of a kick out member 1703.

The straight joint 105 shown in FIG. 17 also has a kick out member 1703 which pivots on a dowel pin 1705. The kick out member is preferably connected to the dowel pin using set screw 1707 which holds the dowel pin in holes 1709. The dowel pin is preferable to a gapped roll pin in this application in order to avoid binding, squeaking and wearing out at points where the dowel pin is attached to the socket portion 1701.

Figure 18:
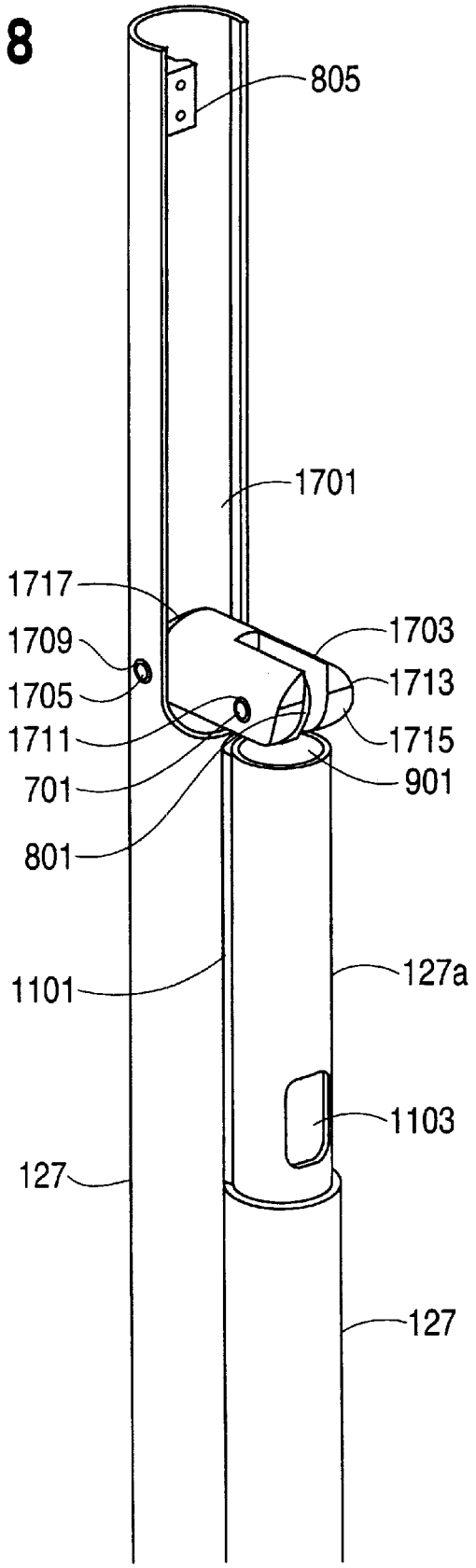
FIG. 18 illustrates the joint of FIG. 17 in the disengaged position.

FIG. 18 provides a more detailed view of the straight joint 105 in the disengaged position. FIG. 18 shows how a movable member connected to the kick out member is free to move outside the socket. Heim joint 801 rotates on roll pin 701 inserted in holes 1711 and kick out member 1703. As illustrated in both FIGS. 17 and 18 kick out member 1703 has a generally U-shaped construction with the roll pin 701 being placed between the upright portions of the U to internally secure the heim joint to the kick out member and to allow the heim joint to move therein. The end positions 1713 and 1715 of the kick out member 1703, however, control how far movable member 127*a* connected to heim joint 801 through plug 901 can rotate. For example, as shown in FIG. 18, the shape of portions 1715 allows clearance for the heim joint to move so that the assembly attached to the heim joint including the cover plate 1101 on movable portion 127*a* does not contact kick out member 1715. However, the shape of end portion 1713 of kick out member 1703 prevents movement in the opposite direction, such that member 127*a* can move only about 90° before coming into contact with surface 1713 of kick out member 17003 preventing further rotation on roll pin 701. Member 127*a* then inserts into the socket portion 1701 as a result of the rotation of the kick out member 1703 on dowel pin 1705. As previously discussed, heim joint 801 has a rod 803 which is connected to plug 901 using a threaded connection. This allows the movable member 127*a* to rotationally turn thereby forming a good fit with the slotted portion 1701 of the joint. The nose 1717 of the kick out member is tapered, thereby allowing the kick out member to clear the inside diameter of the socket when it pivots within the socket. This allows the pipe 127*a* a greater degree of motion, nominally 180°, outside the socket rather than 90°.

Figure 19:
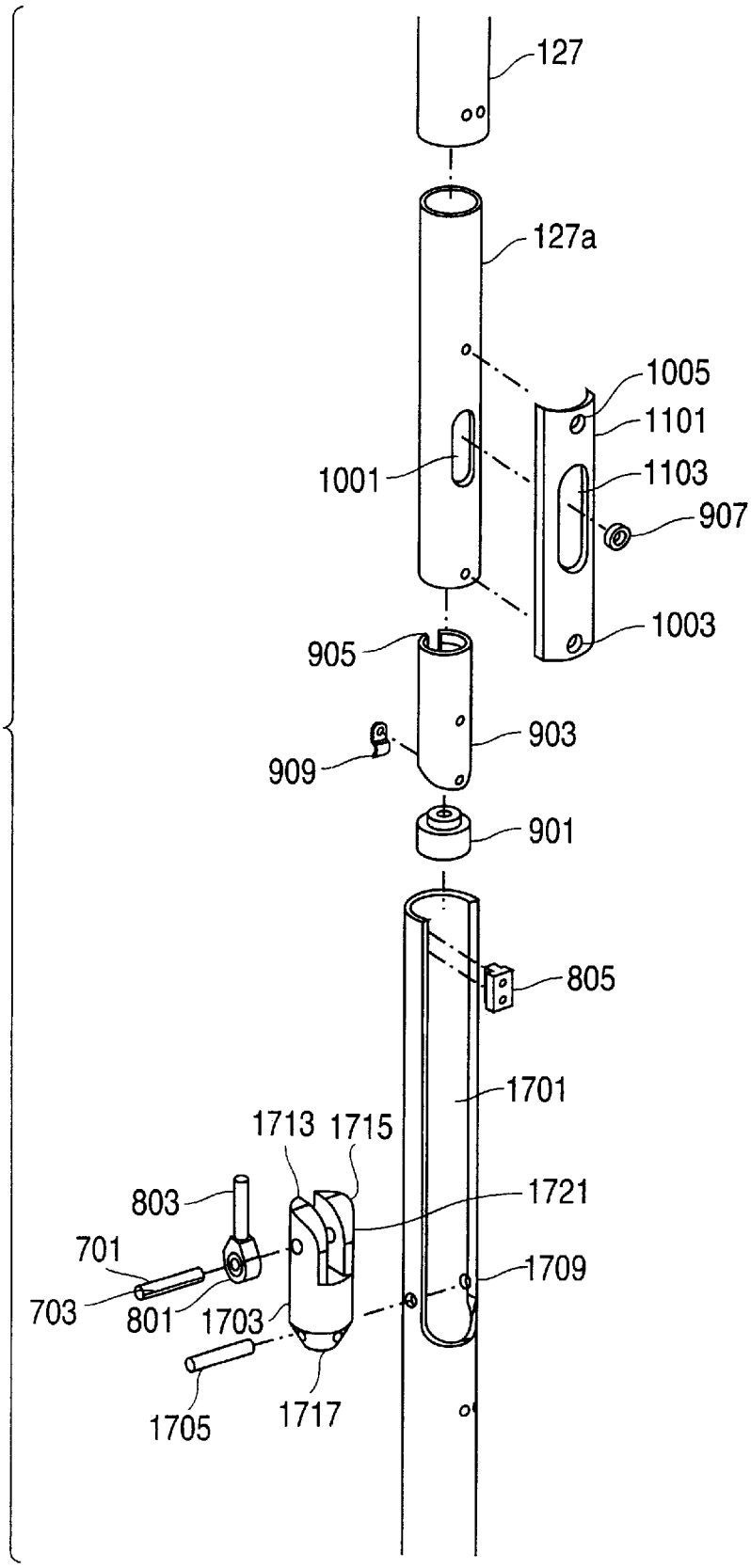
FIG. 19 is an exploded view of the assembly of the straight joint with kick out member according to the invention.

FIG. 19 is an exploded view of the cross bar joint. In this figure, holes 1721 are shown in kick out member 1703 to accommodate insertion of roll pin 701 having gap 703. Frame member 127 is inserted over movable member 127*a*. Member 127 according to the invention could be integrally formed within movable member 127*a* as one piece, just as previously mentioned with respect to members 125 and 125*a*.

Figure 20:
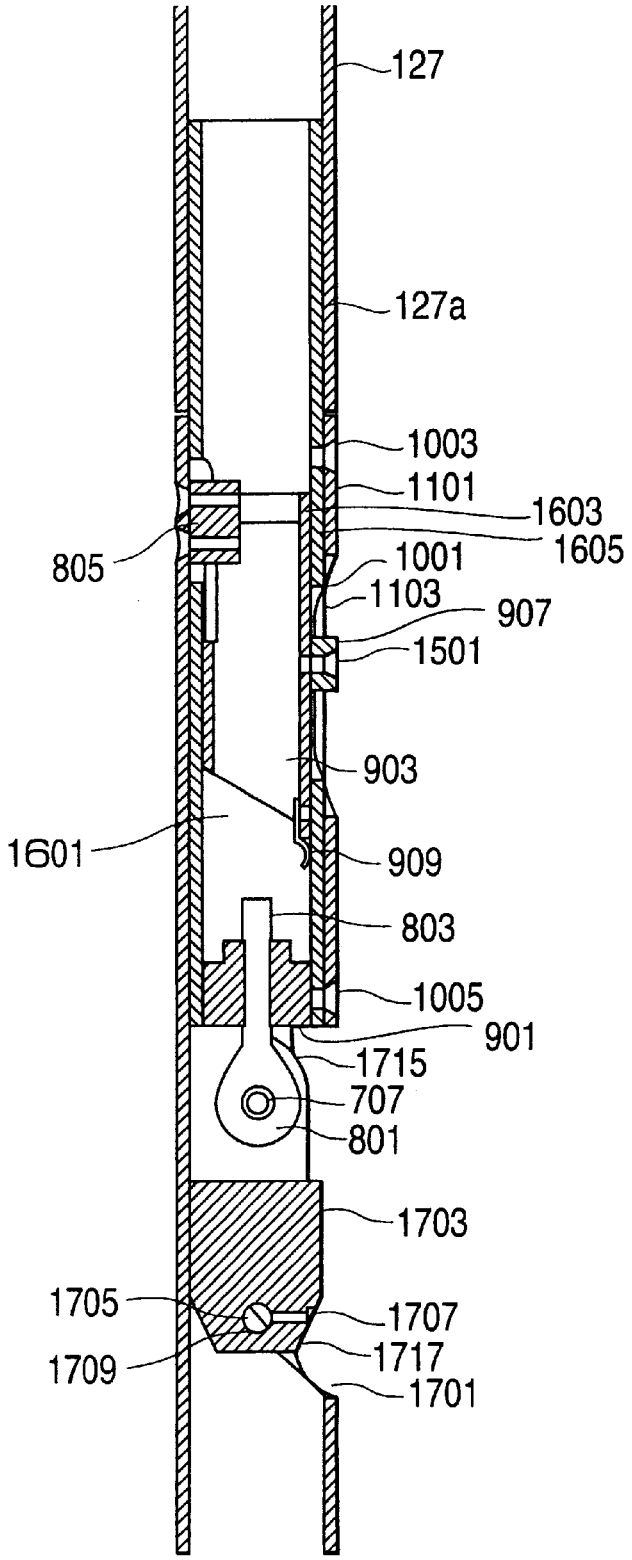
FIG. 20 is a cross sectional view along line D—D in FIG. 17 of the straight joint with kick out member according to the invention in the engaged position.

FIG. 20 illustrates a cross section of straight joint 105 in the engaged position. FIG. 20 clearly shows a hole for a set screw 1707 used to hold dowel pin 1705 inside hole 1709 to allow rotation of kick out piece 1703. As can clearly be seen in FIG. 20, the portions of straight joint 105 are the same as those of corner joint 103 beginning with the connection of rod 803 of heim joint 801 to plug 901. A significant difference between joints 103 and 105 is the addition of the kick out member 1703 and the connections in joints 105 to kick out member 1703. FIG. 20 shows the abutment of kick out member surface 1713 to plug 901 and movable member 127*a*. The principles of the invention for corner and straight joints remain the same.

Figure 21:
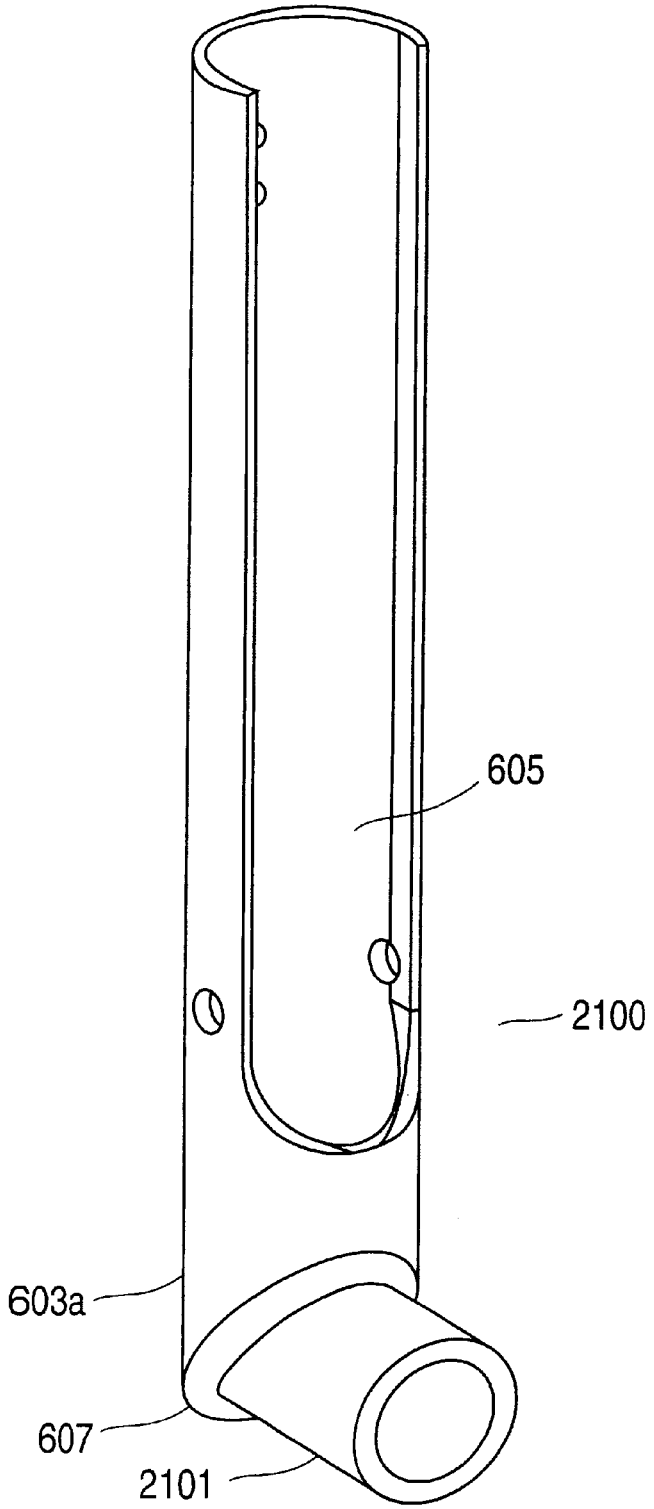
FIG. 21 illustrates an alternative configuration for the socket and attachable portions which may be used to form a corner joint according to the invention.

FIG. 21 illustrates an alternative configuration for the socket and attachable portions of the corner joint 103. FIG. 21 shows member 603 having socket portion 605 therein, as shown in FIG. 6. It will be understood that all of the connections to the socket portion for the movable portion of the joint are the same as those previously discussed herein. Unlike FIG. 6, however, FIG. 21 shows member 2101 extending at an angle from the bottom portion of member 603 in the drawing. In this configuration one need not weld on member 601 to form joints 607. Instead member 2101 can be male or female threaded or not and a member can be attached thereto to provided the fixed portion. Thus, a pipe could be screwed on to member 2101 or a pipe could be attached to member 2101 through a compression fitting, gluing, or some other means. As a result, the joint 2100 shown in FIG. 21 can be manufactured separately from the overall collapsible structure. This ability to manufacture the joint separately may have advantages in certain applications.

Figure 22:
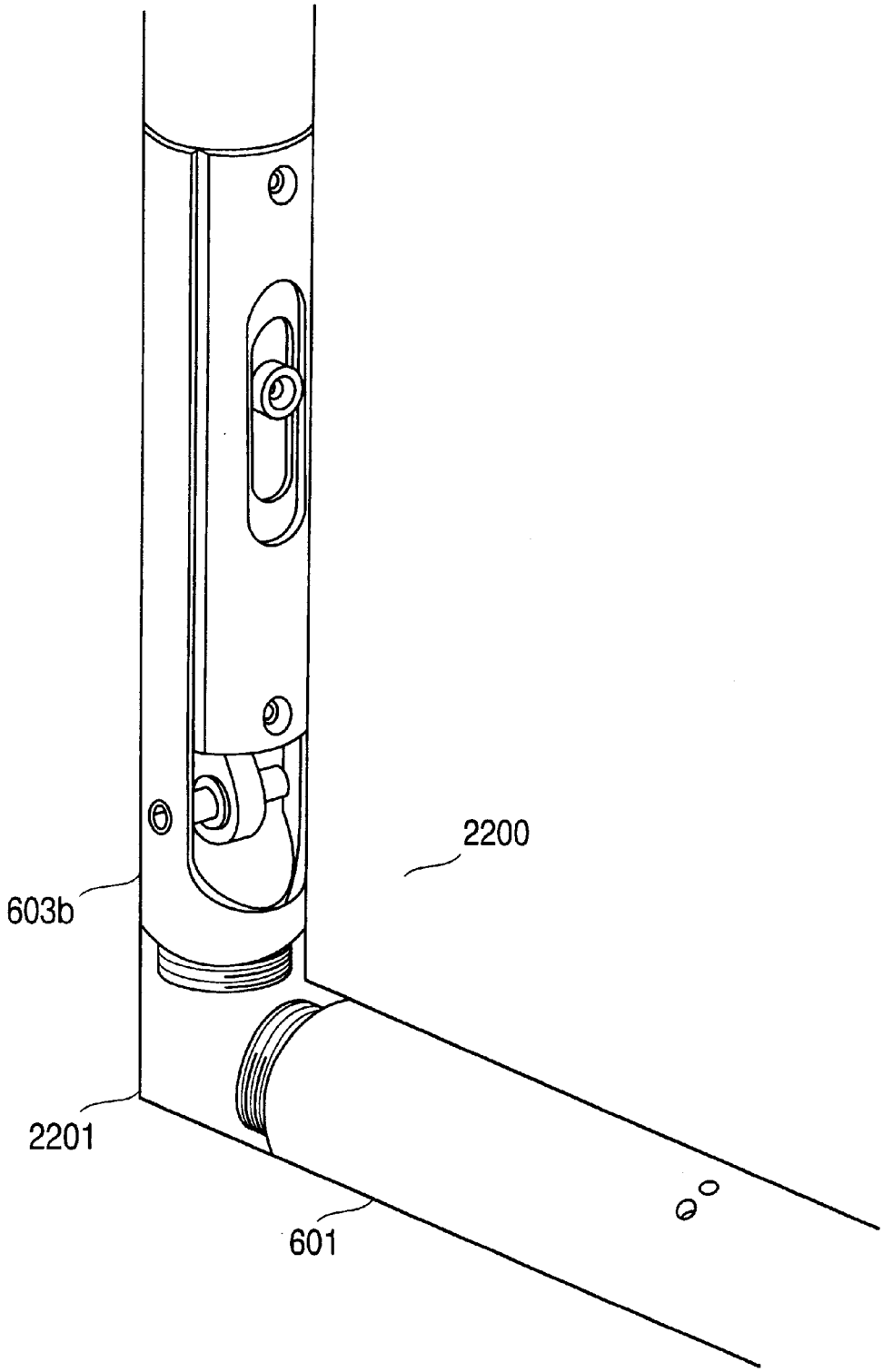
FIG. 22 shows still another alternative configuration using a corner pipe.

FIG. 22 shows an alternative joint 2200, which is another derivative of the joints according to the invention. In FIG. 22 member 603*b* is formed to intersect with a corner pipe 2201. The corner pipe 2201 then attaches to fixed member 601. In this configuration the socket joint 603*b* is attached to the corner 2201 and the corner is attached to a stationary member 601. As in FIG. 21, the connection between the members and the corner piece 2201 can be threaded with the male and female portions of the threads configured as advantageous for a particular application. Alternatively, connections to the corner member 2201 can be of other types, such as compression fittings by gluing.

Figure 23:
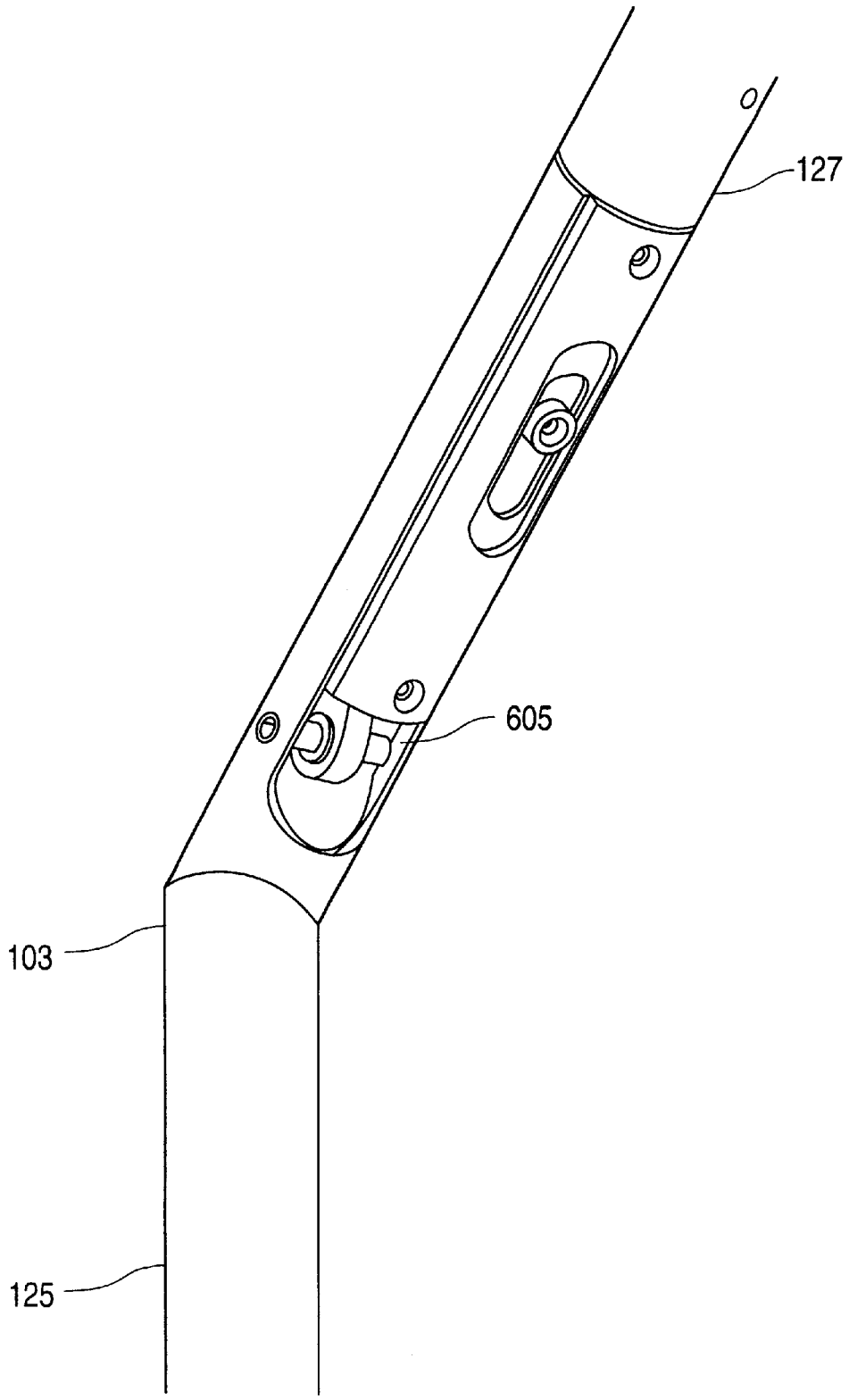
FIG. 23 illustrates that the mouth of the socket can be offset from the direction of the fixed member.

FIG. 23 is a view of upper corner joint 103 from inside the goal shown in FIG. 1. The mouth of the socket portion 605 can be directionally oriented in any desired direction. For example, in the view shown in FIG. 23 the mouth of the socket portion is directionally oriented offset about 30° from an axis along the length of fixed member 125. In addition, the mouth of this socket portion of this upper corner and the socket portion of the other upper corner are aligned or open towards the point joint rather than straight down. In this particular application of a lacrosse goal, such orientation facilitates collapsing the goal into a conveniently portable configuration. According to the invention, socket portion 605 can be positioned at any location around the circumference of the joint in order to achieve the desired result of in the collapsed or erected state.

As discussed herein, the multiple degrees of freedom provided by the joint allows twisting to facilitate collapsing of the frame. Referring again to FIG. 3, it is clear that in the collapsed position the covers on the lower corner joints 103 face each other. In the erect position as shown in FIG. 1, these same covers point rearward perpendicular to the plane of the opening in the goal. This change in the directional or orientation of the covers occurs as a result of the twisting.

It should also be noted that the lock slider is discussed herein in a first configuration oriented to move along the axis of the length of the movable member. Those of ordinary skill will recognize that the lock slider could also be configured in a second orientation to rotate to within the movable member. Both configurations use the inner diameter of the movable member to guide the motion of the lock slider. In the first orientation, the window 1103 is offset along the length of the movable member from window 1001 as shown in FIGS. 11 and 13. In the second configuration, the window 1103 would be positioned directly opposite or behind window 1001.

Figure 24:
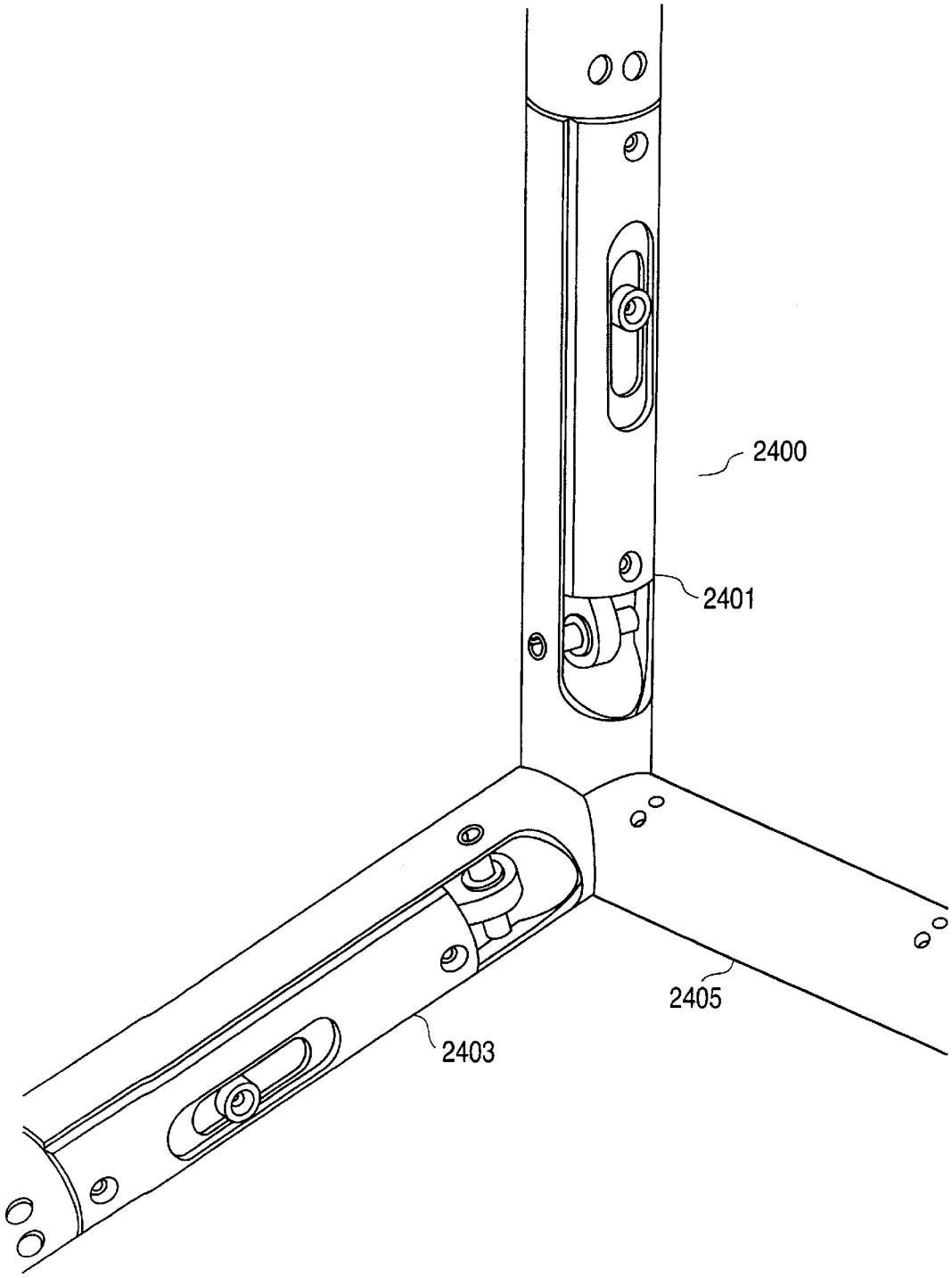
FIG. 24 illustrates a multiple socket joint according to the invention connecting three members.

FIG. 24 illustrates a three bar joint 2400 with two sockets 2401 and 2403 and one stationary member 2405. In the example shown in FIG. 24, each socket 2401 and 2403 is configured as a corner socket. Those of ordinary skill will recognize that any number of such sockets and fixed members can be formed into a single joint. In addition, any combination of sockets and stationary members can be used. Even when multiple socket joints are used, the directional orientation of the socket mouth can be offset from the axis along the length of the frame member, e.g. 2405.

Figure 25:
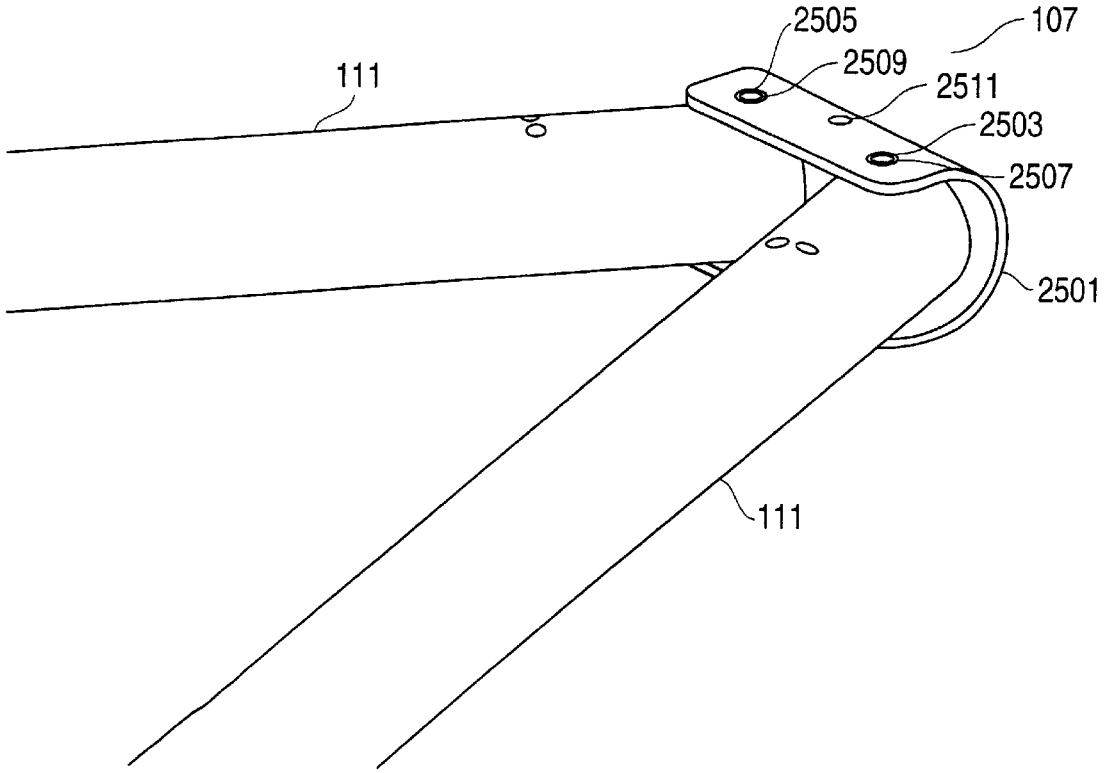
FIG. 25 illustrates a point joint according to the invention.

FIG. 25 illustrates a point joint 107 according to the invention. Point joint 107 has a bracket 2501 with holes 2503 and 2505. Inserted into holes 2503 and 2505 are roll pins 2507 and 2509, respectively. Each roll pin, which is substantially the same as roll pins 701 having a gap 703, as previously discussed herein, extends through holes in the members 111. The size of hole 2303 and 2305 is substantially the same as the size of the roll pin 2307 and 2309. However, the holes in members 111 through which the roll pins pass have a slightly larger diameter, so that members 111 can pivot freely on the roll pins without interference. Members 111 in FIG. 1 are shown as ground members for the lacrosse goal illustrated in that figure. However, the point joint shown in FIG. 25 can be used in other applications. Holes 2511 are used to fasten the net to the point joint.

Figure 26:
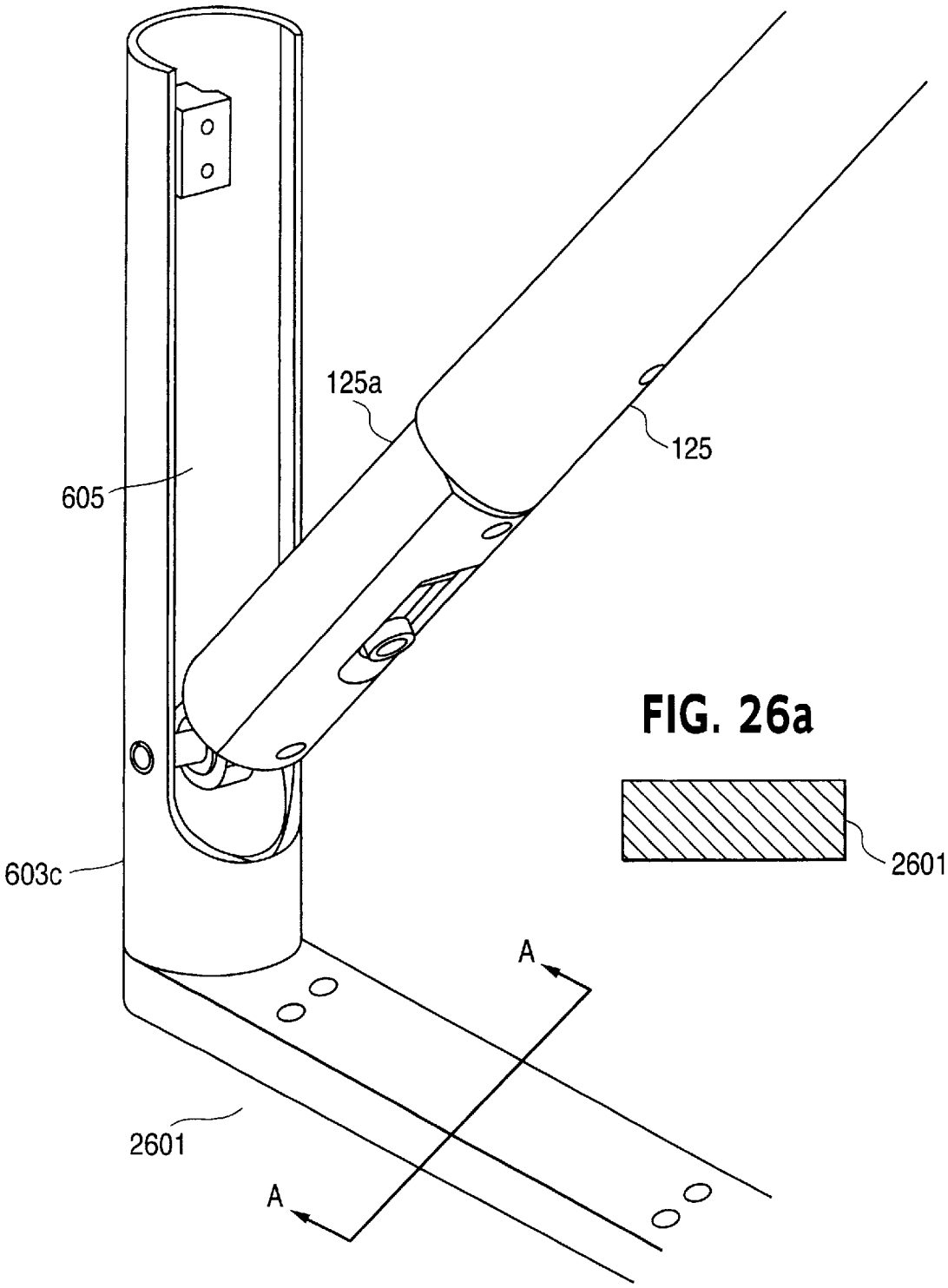
FIG. 26 illustrates a lower corner joint according to the invention wherein the fixed member has a flat shape.

FIG. 26 shows another variation of a joint according to the invention. In FIG. 26 member 603*c* has a slotted portion 605 to accommodate movable member 125*a*. In this case, unlike the previous configurations, member 603*c* intersects a flat member 2601. A cross section of member 2601 is shown in FIG. 26*a*. As illustrated in FIG. 26*a*, the cross section of member 2601 is substantially rectangular. Of course a square or other flat configuration could also be used. A flat member such as member 2601 may be useful in certain game goals where NCAA specifications permit. For example, NCAA specifications permit use of flat ground members in the cross goals and is especially useful when playing artificial surfaces. Member 2601 can be attached to member 603*c* by welding, bolting, threaded connection, insertion and gluing or other fastening means. Those of ordinary skill will recognize that member 2601 could be of any other shape while still being within the scope of the invention. For example, member 2601 could have a triangular, hexangular or octagonal cross section, without departing from the scope or the intent of the invention.

Figure 27:
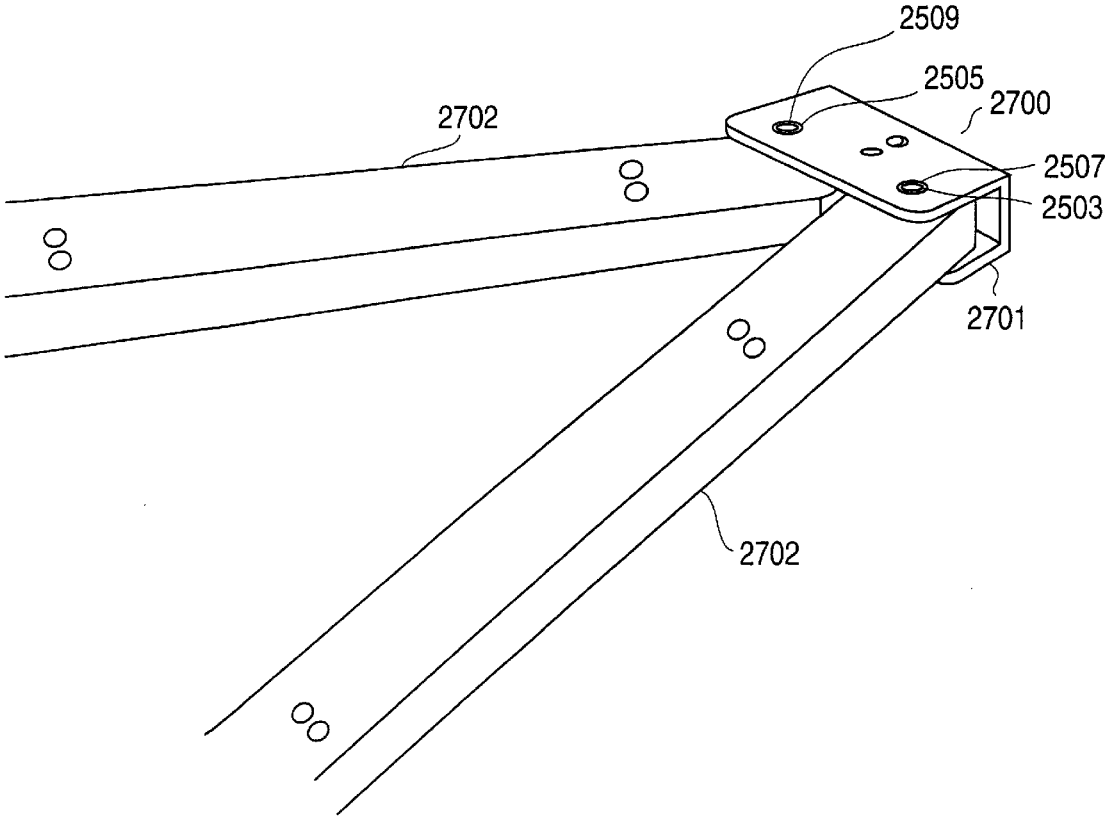
FIG. 27 illustrates a point joint using flat cross sectional members.

FIG. 27 illustrates a point joint 2700 constructed using a sharp angle bracket 2701 and flat members 2702. As illustrated in FIG. 27, the connection between the holes and the roll pins would follow the same design consideration as that given in FIG. 25 for the roll point joint connecting to rounded members. Similarly, the net could be attached at holes 2511.

Figure 28:
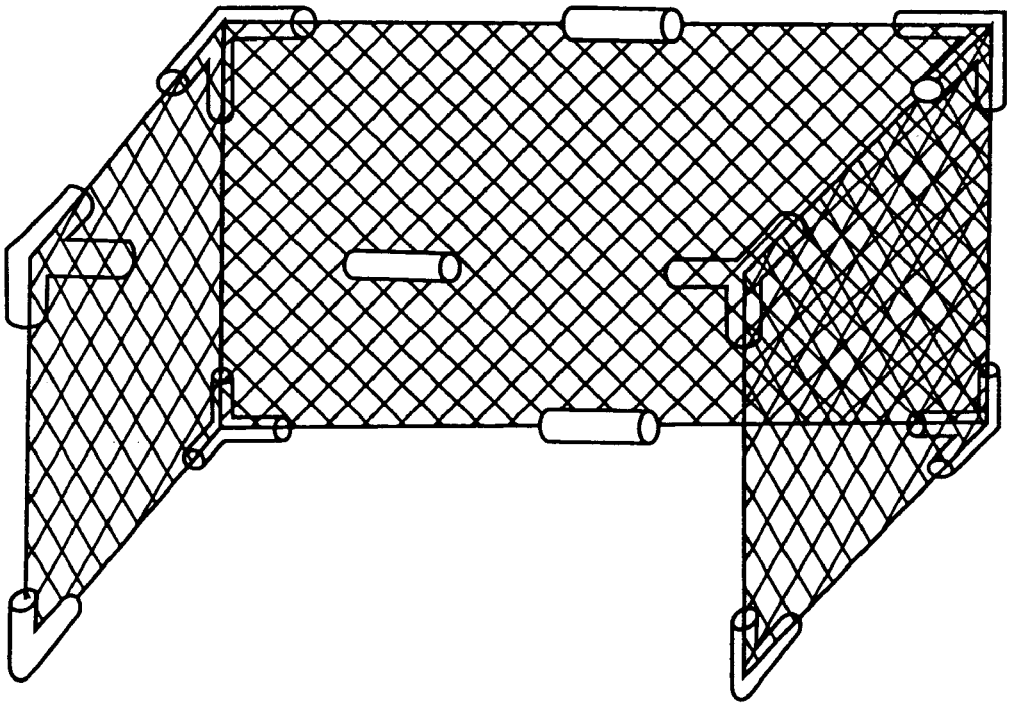
FIG. 28 illustrates a game goal in which three members come together at some corners.

FIG. 28 shows an example of a game goal in which three members come together at some of the corners. As previously discussed herein, joints according to the invention can encompass any number of such corners and could be used to form a collapsible goal where more than two frame members intersect.

Figure 29:
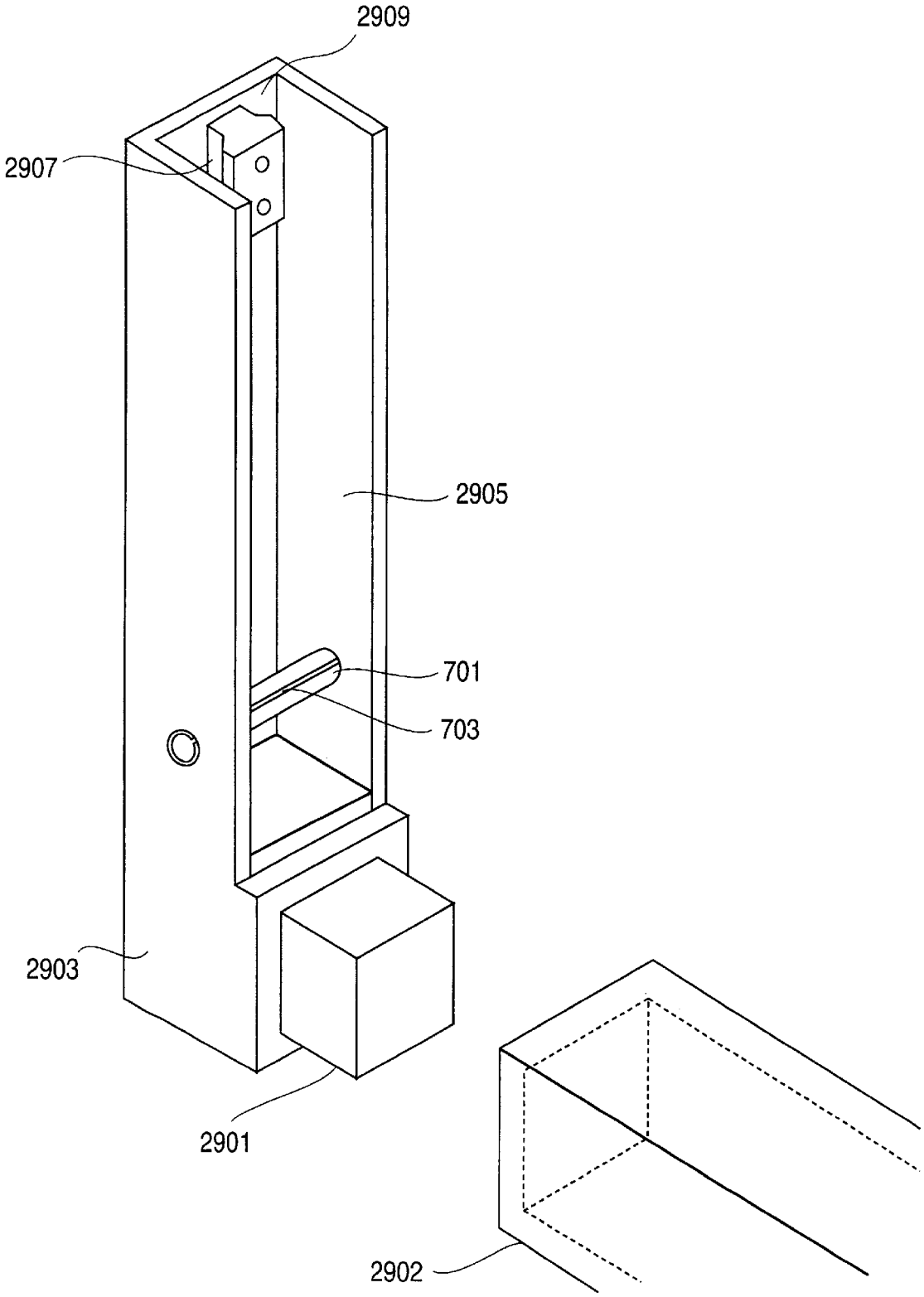
FIG. 29 illustrates another variation on the socket according to the invention wherein the cross section is not circular.

FIG. 29 is a further variation on the joints shown in FIG. 21. FIG. 29 differs from FIG. 21 in that the joint shown in FIG. 29 has sharp edges. In FIG. 29, member 2901 intersects with the fixed member 2902. Member 2903 having a slotted portion 2905 therein is configured for insertion of the movable member. Wedge lock 2907 is placed on the rear wall 2909 of slotted portion 2905. As shown by way of illustration in FIG. 29*a* movable member rotates using a heim joint on roll pin 701 having gap 703 therein.

As will be recognized by those of ordinary skill, other configurations of joints having various external shapes can be accommodative within the scope of the invention. All joint structures according to the invention fit within the outer diameter specification sports goals set by the NCAA.

The snap fit between the movable members and their corresponding joint sockets holds the movable members in place in the absence of engagement of the lock slider with the locks wedge. When erecting a goal or other structure, the structure stays upright allowing one to lock the frame members in place in any order. When collapsing a goal or other structure, the snap fit prevents the structure from falling over when the lock wedges are disengaged. The snap fit forces one to intentionally collapse the structure when desired. This provides a safety advantage.

Figure 30A:
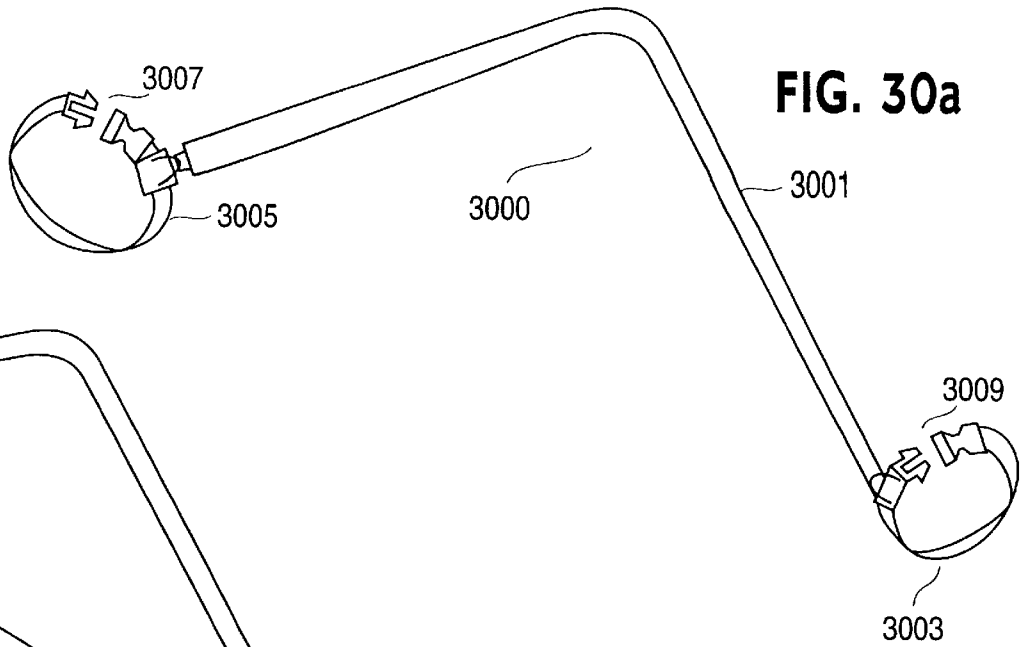
FIG. 30*a* illustrates a shoulder strap according to the invention.
Figure 30B:
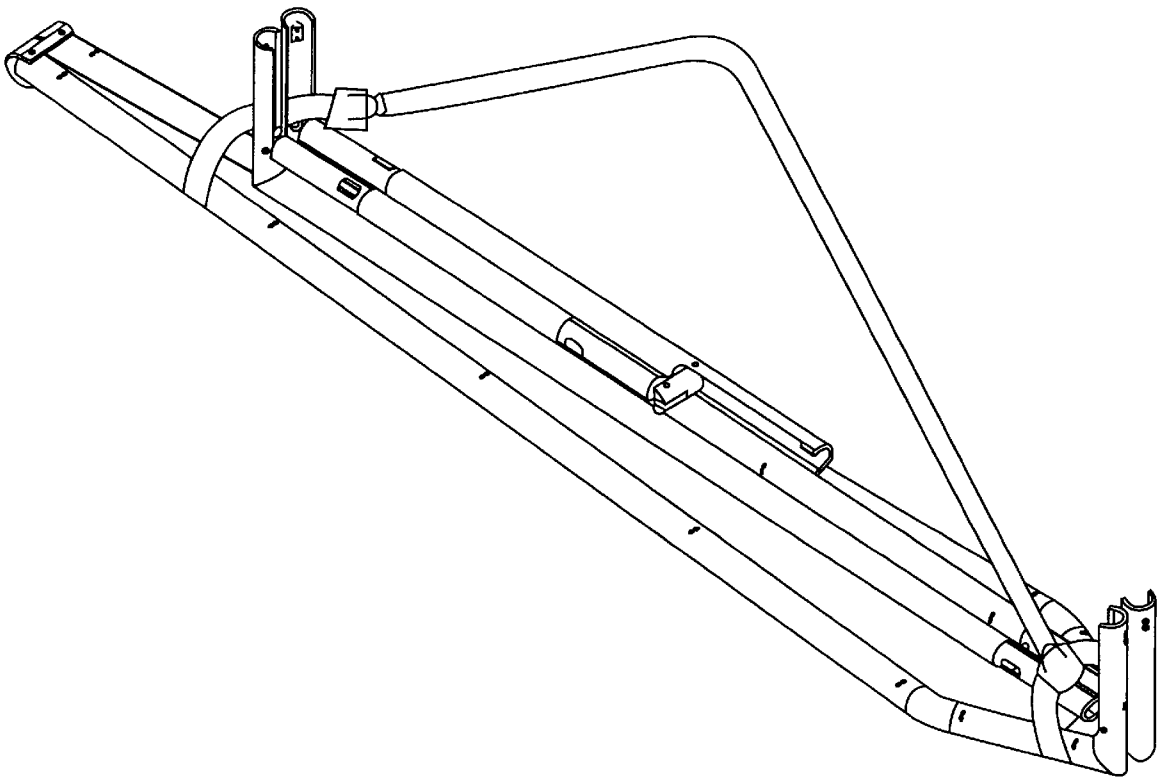
FIG. 30*b* illustrates the shoulder strap of FIG. 30*a* in use to carry a collapsed structure.

FIG. 30*a* illustrates a shoulder strap 3000 according to the invention which can be used in carrying a goal such as a lacrosse goal. Shoulder strap has a strap or cord 3001 and end members 3003 and 3005. Strap 3001 can be fixedly or removably attached to the end members. The end members 3003 and 3005 each have a buckle 3007 and 3009 which, when closed results in the end member having a generally circular configuration, which can be used to enclose portions of the goal to facilitate carrying. FIG. 30*b* shows the shoulder strap connected to the end members in use to carry the goal in the collapsed configuration shown in FIG. 3.

Figure 31:
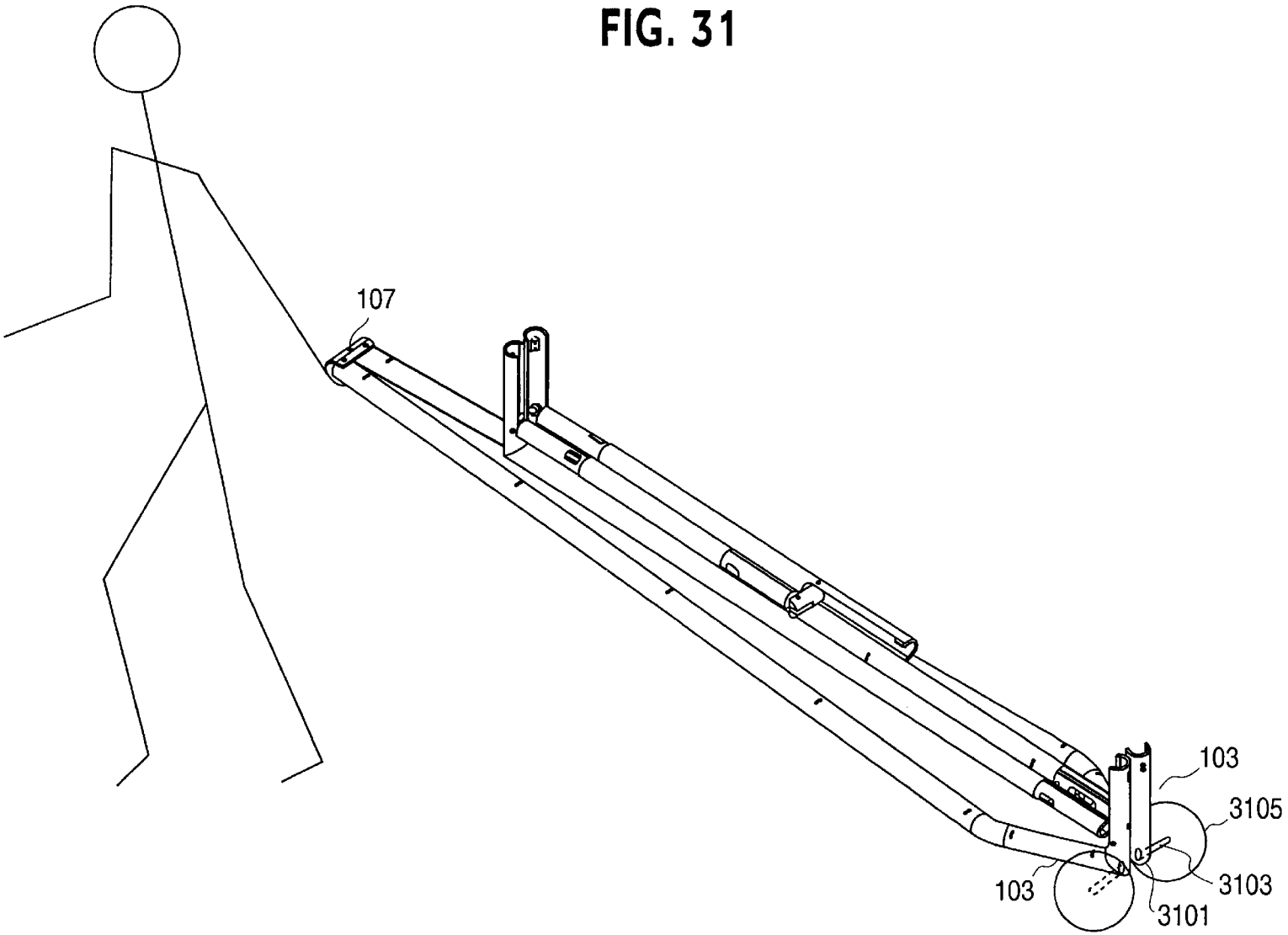
FIG. 31 illustrates a configuration according to the invention which allows a collapsed structure to be moved on wheels.

FIG. 31 shows another means of transporting the collapsed goal of FIG. 3. In FIG. 31 the goal is shown with slots 3101 in the base corner joints 103. The slots accommodate an axle 3103 to which wheels 3105 are attached. Point joint 107 can then be used to tow the collapsed assembly on wheels. Pins stick up from the axle to hold it in place.

Figure 32:
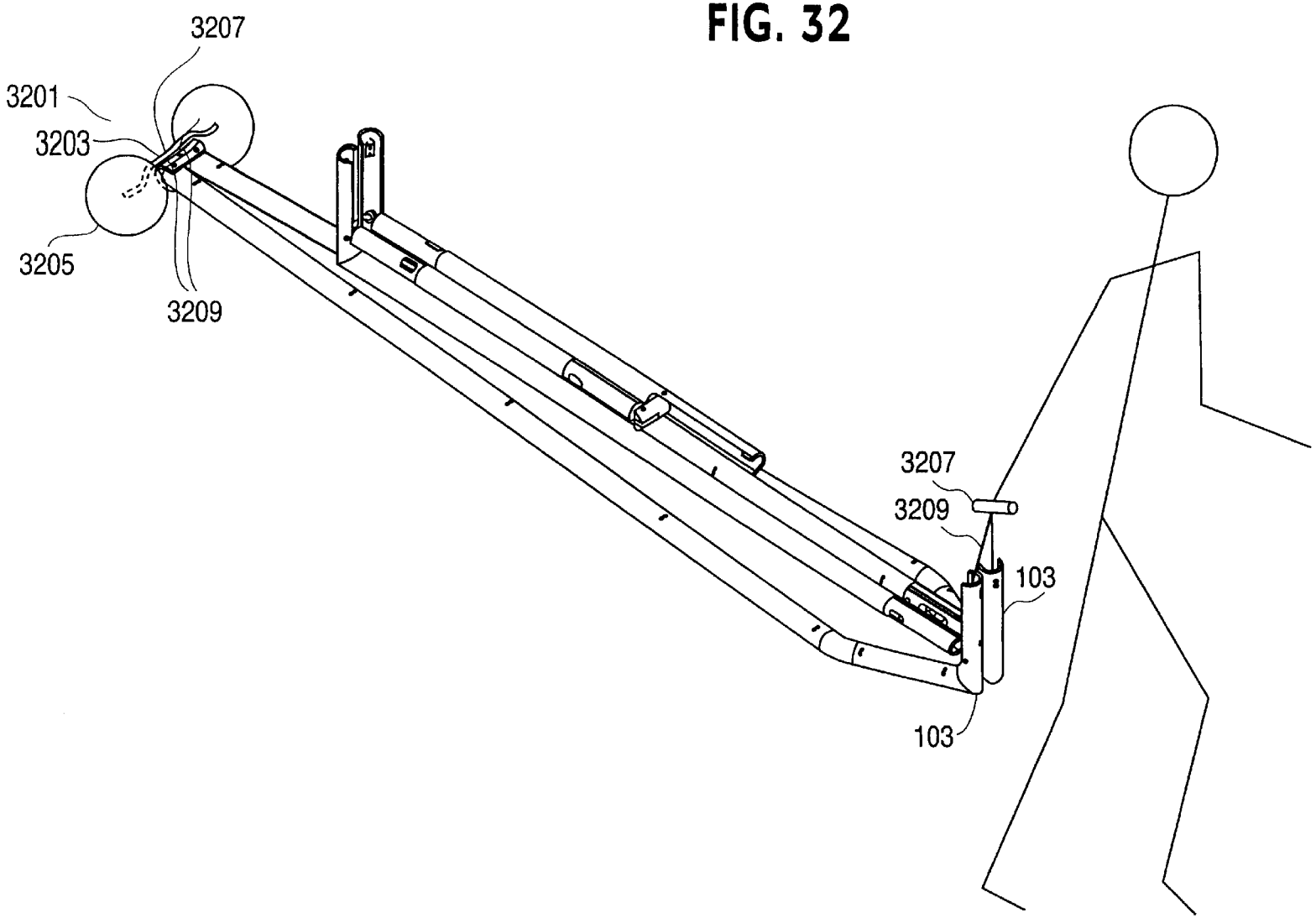
FIG. 32 represents an alternative structure according to the invention which allows a collapsed structure to be transported on wheels.

FIG. 32 shows still another configuration for towing a collapsed goal according to the invention. In this configuration the point joint 107 has attached thereto a clip on assembly 3201 with an axle 3202 and wheels 3205. The handle strap 3209 loops over the lock wedges 805 inside the slotted portions 605 of the corner joints 103. Alternatively, the handle 3207 is inserted into holes in the slot portions of joints 103 at the base of the collapsed assembly. The handle and wheels are then used to tow the goal. In the arrangement in FIG. 32, the weight of the goal pushes down onto the dog leg portion of axle 3207, forcing sheer on the pins 3209 which keep the wheels on the axle.

While several embodiments of the invention have been described, it will be understood that it is capable of further modifications. For example, the goals described herein use a net the means for receiving a projectile. It will be understood that a net is used to allow spectators and unobstructed view of the game. Alternatively, a solid cloth could be used in place of a net. Such a cloth could be clear, opaque or any combination thereof. Similarly, a projectile receiving means could be made of portions of a solid cloth or any other composition approximating the functionality of a net or webbing. Thus this application is intended to cover any variations, uses or additions of the invention, following in general the principals of the invention and including such departures from the disclosure as to come within the knowledge or a customary practice in the art to which invention pertains, and as may be applied to the essential features herein before set forth and falling within the scope of the invention or the limits of the appended claims. It will be further recognized that the particular shape of the joint whether it be rounded, square, rectangular, hexagonal, octagonal, triangular, or any other shape are all within the scope of the invention. It will be further recognized that joints according to the invention can be constructed to be oriented in any direction and with any number elements. For example, a corner joint can have two or more elements with any combination of movable and fixed members.

What is claimed is:

1. A joint for linking members of a collapsible assembly, said joint comprising:

a socket portion having a mouth portion smaller than an inner diameter of the socket portion;

a roll pin mounted within the mouth portion of the socket portion;

a movable member connectable to a member of said collapsible assembly; and a rod positioned within said socket portion, said rod being movable in and out of said socket portion, said rod having a connection at one end for rotatably mounting said movable member thereto and a connection at an opposite end to said roll pin, said rod being pivotable about said roll pin, wherein the movable member is laterally insertable in and out of the mouth portion of the socket portion.

2. A joint as recited in claim 1, said connection for rotatably mounting said movable member comprising a threaded end.

3. A joint as recited in claim 2, said rod having at an end opposite said threaded end a connection within said socket directing motion of said rod in and out of said socket portion.

4. A joint as recited in claim 3, wherein the socket portion provides a snap fit to the movable member when engaged with each other.

5. A joint as recited in claim 4, said rod comprising a heim joint.

6. A joint as recited in claim 1, said collapsible assembly comprising a game goal.

7. A joint as recited in claim 6, said game goal comprising a net.

8. A joint as recited in claim 7, said net being attached to a frame member, said frame member being attached to said movable member in both a collapsed position and an erect position.

9. A joint as recited in claim 1, said joint providing multiple degrees of freedom of motion for said movable member in transition between a collapsed position and an erect position.

10. A joint as recited in claim 9, said rod having a threaded end for connection to said movable member.

11. A joint as recited in claim 10 comprising a roll pin, said rod having a connector rotatable around said roll pin.

12. A joint as recited in claim 1, comprising a lock.

13. A joint as recited in claim 12, said lock comprising a wedge and a lock slider.

14. A joint as recited in claim 13, wherein said lock slider comprises a drag producing member.

15. A joint as recited in claim 1, comprising a frame member, said frame member being connectable with said movable member.

16. A joint as recited in claim 1, comprising a fixed portion.

17. A joint as recited in claim 16, wherein a positional relationship between said socket portion and said fixed portion determines an orientation of said fixed portion of said collapsible assembly in an erect position and a collapsed position.

18. A joint as recited in claim 1 comprising:

a dowel pin extending between walls of said socket portion; and a kick out member pivotable on said dowel pin.

19. A joint as recited in claim 18, comprising a fixed portion, said moveable member being parallel to said fixed portion in a collapsed position.

20. A joint as recited in claim 1 comprising a plurality of said socket portions.

21. A joint as recited in claim 17 comprising a plurality of said socket portions.

22. A joint as recited in claim 16 said frame member having a shape complementary to a shape of said socket portion to fit therein.

* * * * *